US007586484B2

(12) United States Patent
Sampsell et al.

(10) Patent No.: US 7,586,484 B2
(45) Date of Patent: Sep. 8, 2009

(54) CONTROLLER AND DRIVER FEATURES FOR BI-STABLE DISPLAY

(75) Inventors: Jeffrey B. Sampsell, San Jose, CA (US); Karen Tyger, Foster City, CA (US); Mithran Mathew, Mountain View, CA (US)

(73) Assignee: IDC, LLC, San Francisco, CA (US)

( * ) Notice: Subject to any disclaimer, the term of this patent is extended or adjusted under 35 U.S.C. 154(b) by 718 days.

(21) Appl. No.: 11/096,546

(22) Filed: Apr. 1, 2005

(65) Prior Publication Data

US 2006/0066503 A1 Mar. 30, 2006

Related U.S. Application Data

(60) Provisional application No. 60/613,412, filed on Sep. 27, 2004.

(51) Int. Cl.
*G09G 5/00* (2006.01)

(52) U.S. Cl. ..... 345/204; 345/97; 345/103; 345/107; 345/109

(58) Field of Classification Search ..... 345/204, 345/107, 109

See application file for complete search history.

(56) References Cited

U.S. PATENT DOCUMENTS

| | | | |
|---|---|---|---|
| 2,534,846 | A | 12/1950 | Ambrose et al. |
| 3,184,600 | A | 5/1965 | Potter |
| 3,371,345 | A | 2/1968 | Lewis |
| 3,410,363 | A | 11/1968 | Schwartz |
| 3,439,973 | A | 4/1969 | Paul et al. |

(Continued)

FOREIGN PATENT DOCUMENTS

| | | | |
|---|---|---|---|
| EP | 0261897 | A2 | 3/1988 |

(Continued)

OTHER PUBLICATIONS

Akasaka, "Three-Dimensional IC Trends," Proceedings of IEEE, vol. 74, No. 12, pp. 1703-1714 (Dec. 1986).

(Continued)

*Primary Examiner*—Richard Hjerpe
*Assistant Examiner*—Leonid Shapiro
(74) *Attorney, Agent, or Firm*—Knobbe Martens Olson & Bear, LLP

(57) ABSTRACT

The invention comprises systems and methods for partitioning displays, and in particular, displays of interferometric modulator displays. In one embodiment, a display system includes one driving circuit configured to provide signals based on video data intended for display, and a bi-stable display comprising an array having a plurality of bi-stable display elements. The array is configured to display video data using signals received from the driving circuit, and the driving circuit is configured to partition the array into two or more fields, each field including at least one bi-stable display element, and refresh each of the two or more fields in accordance with a refresh rate associated with each field. In another embodiment, a method of displaying data on a display of a client device includes partitioning a bi-stable display of the client device into two or more fields, displaying video data in the two or more fields, and refreshing each of the two or more fields in accordance with a refresh rate that is associated with each field.

20 Claims, 13 Drawing Sheets

U.S. PATENT DOCUMENTS

| | | | | |
|---|---|---|---|---|
| 3,443,854 | A | | 5/1969 | Weiss |
| 3,653,741 | A | | 4/1972 | Marks |
| 3,656,836 | A | | 4/1972 | de Cremoux et al. |
| 3,746,785 | A | | 7/1973 | Te Velde |
| 3,813,265 | A | | 5/1974 | Marks |
| 3,955,880 | A | | 5/1976 | Lierke |
| 3,972,040 | A | | 7/1976 | Hilsum et al. |
| 4,099,854 | A | | 7/1978 | Decker et al. |
| 4,228,437 | A | | 10/1980 | Shelton |
| 4,347,983 | A | | 9/1982 | Bodai |
| 4,377,324 | A | | 3/1983 | Durand et al. |
| 4,389,096 | A | | 6/1983 | Hori et al. |
| 4,392,711 | A | | 7/1983 | Moraw et al. |
| 4,403,248 | A | | 9/1983 | te Velde |
| 4,441,791 | A | | 4/1984 | Hornbeck |
| 4,445,050 | A | | 4/1984 | Marks |
| 4,459,182 | A | | 7/1984 | Te Velde |
| 4,482,213 | A | | 11/1984 | Piliavin et al. |
| 4,500,171 | A | | 2/1985 | Penz et al. |
| 4,519,676 | A | | 5/1985 | te Velde |
| 4,531,126 | A | | 7/1985 | Sadones |
| 4,566,935 | A | | 1/1986 | Hornbeck |
| 4,571,603 | A | | 2/1986 | Hornbeck et al. |
| 4,596,992 | A | | 6/1986 | Hornbeck |
| 4,615,595 | A | | 10/1986 | Hornbeck |
| 4,662,746 | A | | 5/1987 | Hornbeck |
| 4,663,083 | A | | 5/1987 | Marks |
| 4,681,403 | A | | 7/1987 | te Velde et al. |
| 4,710,732 | A | | 12/1987 | Hornbeck |
| 4,748,366 | A | | 5/1988 | Taylor |
| 4,786,128 | A | | 11/1988 | Birnbach |
| 4,790,635 | A | | 12/1988 | Apsley |
| 4,798,437 | A | * | 1/1989 | Rediker et al. ..... 385/3 |
| 4,856,863 | A | | 8/1989 | Sampsell et al. |
| 4,857,978 | A | | 8/1989 | Goldburt et al. |
| 4,859,060 | A | | 8/1989 | Katagiri et al. |
| 4,900,136 | A | | 2/1990 | Goldburt et al. |
| 4,900,395 | A | | 2/1990 | Syverson et al. |
| 4,954,789 | A | | 9/1990 | Sampsell |
| 4,956,619 | A | | 9/1990 | Hornbeck |
| 4,965,562 | A | | 10/1990 | Verhulst |
| 4,977,009 | A | | 12/1990 | Anderson et al. |
| 4,982,184 | A | | 1/1991 | Kirkwood |
| 5,018,256 | A | | 5/1991 | Hornbeck |
| 5,022,745 | A | | 6/1991 | Zahowski et al. |
| 5,028,939 | A | | 7/1991 | Hornbeck et al. |
| 5,037,173 | A | | 8/1991 | Sampsell et al. |
| 5,044,736 | A | | 9/1991 | Jaskie et al. |
| 5,061,049 | A | | 10/1991 | Hornbeck |
| 5,075,796 | A | | 12/1991 | Schildkraut et al. |
| 5,078,479 | A | | 1/1992 | Vuilleumier |
| 5,079,544 | A | | 1/1992 | DeMond et al. |
| 5,083,857 | A | | 1/1992 | Hornbeck |
| 5,096,279 | A | | 3/1992 | Hornbeck et al. |
| 5,099,353 | A | | 3/1992 | Hornbeck |
| 5,124,834 | A | | 6/1992 | Cusano et al. |
| 5,126,836 | A | | 6/1992 | Um |
| 5,142,405 | A | | 8/1992 | Hornbeck |
| 5,142,414 | A | | 8/1992 | Koehler |
| 5,148,157 | A | | 9/1992 | Florence |
| 5,153,771 | A | | 10/1992 | Link et al. |
| 5,162,787 | A | | 11/1992 | Thompson et al. |
| 5,168,406 | A | | 12/1992 | Nelson |
| 5,170,156 | A | | 12/1992 | DeMond et al. |
| 5,172,262 | A | | 12/1992 | Hornbeck |
| 5,179,274 | A | | 1/1993 | Sampsell |
| 5,185,660 | A | | 2/1993 | Um |
| 5,192,395 | A | | 3/1993 | Boysel et al. |
| 5,192,946 | A | | 3/1993 | Thompson et al. |
| 5,206,629 | A | | 4/1993 | DeMond et al. |
| 5,214,419 | A | | 5/1993 | DeMond et al. |
| 5,214,420 | A | | 5/1993 | Thompson et al. |
| 5,216,537 | A | | 6/1993 | Hornbeck |
| 5,226,099 | A | | 7/1993 | Mignardi et al. |
| 5,228,013 | A | | 7/1993 | Bik |
| 5,231,532 | A | | 7/1993 | Magel et al. |
| 5,233,385 | A | | 8/1993 | Sampsell |
| 5,233,456 | A | | 8/1993 | Nelson |
| 5,233,459 | A | | 8/1993 | Bozler et al. |
| 5,244,707 | A | | 9/1993 | Shores |
| 5,254,980 | A | | 10/1993 | Hendrix et al. |
| 5,272,473 | A | | 12/1993 | Thompson et al. |
| 5,278,652 | A | | 1/1994 | Urbanus et al. |
| 5,280,277 | A | | 1/1994 | Hornbeck |
| 5,287,096 | A | | 2/1994 | Thompson et al. |
| 5,293,272 | A | | 3/1994 | Jannson et al. |
| 5,296,950 | A | | 3/1994 | Lin et al. |
| 5,304,419 | A | | 4/1994 | Shores |
| 5,305,640 | A | | 4/1994 | Boysel et al. |
| 5,311,360 | A | | 5/1994 | Bloom et al. |
| 5,312,513 | A | | 5/1994 | Florence et al. |
| 5,323,002 | A | | 6/1994 | Sampsell et al. |
| 5,324,683 | A | | 6/1994 | Fitch et al. |
| 5,325,116 | A | | 6/1994 | Sampsell |
| 5,326,430 | A | | 7/1994 | Cronin et al. |
| 5,327,286 | A | | 7/1994 | Sampsell et al. |
| 5,331,454 | A | | 7/1994 | Hornbeck |
| 5,339,116 | A | | 8/1994 | Urbanus et al. |
| 5,353,114 | A | | 10/1994 | Hansen |
| 5,358,601 | A | | 10/1994 | Cathey |
| 5,365,283 | A | | 11/1994 | Doherty et al. |
| 5,381,253 | A | | 1/1995 | Sharp et al. |
| 5,401,983 | A | | 3/1995 | Jokerst et al. |
| 5,411,769 | A | | 5/1995 | Hornbeck |
| 5,444,566 | A | | 8/1995 | Gale et al. |
| 5,446,479 | A | | 8/1995 | Thompson et al. |
| 5,448,314 | A | | 9/1995 | Heimbuch et al. |
| 5,450,205 | A | | 9/1995 | Sawin et al. |
| 5,452,024 | A | | 9/1995 | Sampsell |
| 5,454,906 | A | | 10/1995 | Baker et al. |
| 5,457,493 | A | | 10/1995 | Leddy et al. |
| 5,457,566 | A | | 10/1995 | Sampsell et al. |
| 5,459,602 | A | | 10/1995 | Sampsell |
| 5,459,610 | A | | 10/1995 | Bloom et al. |
| 5,461,411 | A | | 10/1995 | Florence et al. |
| 5,474,865 | A | | 12/1995 | Vasudev |
| 5,489,952 | A | | 2/1996 | Gove et al. |
| 5,497,172 | A | | 3/1996 | Doherty et al. |
| 5,497,197 | A | | 3/1996 | Gove et al. |
| 5,499,037 | A | | 3/1996 | Nakagawa et al. |
| 5,499,062 | A | | 3/1996 | Urbanus |
| 5,500,635 | A | | 3/1996 | Mott |
| 5,500,761 | A | | 3/1996 | Goossen et al. |
| 5,506,597 | A | | 4/1996 | Thompson et al. |
| 5,515,076 | A | | 5/1996 | Thompson et al. |
| 5,517,347 | A | | 5/1996 | Sampsell |
| 5,523,803 | A | | 6/1996 | Urbanus et al. |
| 5,526,051 | A | | 6/1996 | Gove et al. |
| 5,526,172 | A | | 6/1996 | Kanack |
| 5,526,327 | A | | 6/1996 | Cordova, Jr. |
| 5,526,688 | A | | 6/1996 | Boysel et al. |
| 5,530,240 | A | | 6/1996 | Larson et al. |
| 5,535,047 | A | | 7/1996 | Hornbeck |
| 5,546,104 | A | | 8/1996 | Kuga |
| 5,548,301 | A | | 8/1996 | Kornher et al. |
| 5,548,329 | A | | 8/1996 | Klatt |
| 5,550,373 | A | | 8/1996 | Cole et al. |
| 5,551,293 | A | | 9/1996 | Boysel et al. |
| 5,552,568 | A | | 9/1996 | Onodaka et al. |
| 5,552,924 | A | | 9/1996 | Tregilgas |
| 5,552,925 | A | | 9/1996 | Worley |
| 5,559,358 | A | | 9/1996 | Burns et al. |
| 5,563,398 | A | | 10/1996 | Sampsell |
| 5,567,334 | A | | 10/1996 | Baker et al. |

5,570,135 A 10/1996 Gove et al.
5,576,731 A 11/1996 Whitby et al.
5,579,149 A 11/1996 Moret et al.
5,580,144 A 12/1996 Stroomer
5,581,272 A 12/1996 Conner et al.
5,583,534 A 12/1996 Katakura et al.
5,583,688 A 12/1996 Hornbeck
5,589,852 A 12/1996 Thompson et al.
5,591,379 A 1/1997 Shores
5,597,736 A 1/1997 Sampsell
5,600,383 A 2/1997 Hornbeck
5,602,671 A 2/1997 Hornbeck
5,606,441 A 2/1997 Florence et al.
5,608,468 A 3/1997 Gove et al.
5,610,438 A 3/1997 Wallace et al.
5,610,624 A 3/1997 Bhuva
5,610,625 A 3/1997 Sampsell
5,619,059 A 4/1997 Li et al.
5,619,365 A 4/1997 Rhoades et al.
5,619,366 A 4/1997 Rhoads et al.
5,629,521 A 5/1997 Lee et al.
5,629,790 A 5/1997 Neukermans et al.
5,636,052 A 6/1997 Arney et al.
5,636,185 A 6/1997 Brewer et al.
5,646,768 A 7/1997 Kaeiyama
5,650,881 A 7/1997 Hornbeck
5,654,741 A 8/1997 Sampsell et al.
5,657,099 A 8/1997 Doherty et al.
5,659,374 A 8/1997 Gale, Jr. et al.
5,665,997 A 9/1997 Weaver et al.
5,673,139 A 9/1997 Johnson
5,683,591 A 11/1997 Offenberg
5,699,074 A 12/1997 Sutherland et al.
5,703,710 A 12/1997 Brinkman et al.
5,710,656 A 1/1998 Goosen
5,726,480 A 3/1998 Pister
5,739,945 A 4/1998 Tayebati
5,745,193 A 4/1998 Urbanus et al.
5,745,281 A 4/1998 Yi et al.
5,771,116 A 6/1998 Miller et al.
5,784,190 A 7/1998 Worley
5,784,212 A 7/1998 Hornbeck
5,793,504 A 8/1998 Stoll
5,808,780 A 9/1998 McDonald
5,815,141 A 9/1998 Phares
5,818,095 A 10/1998 Sampsell
5,825,528 A 10/1998 Goosen
5,835,255 A 11/1998 Miles
5,842,088 A 11/1998 Thompson
5,909,205 A 6/1999 Furuhashi et al.
5,912,758 A 6/1999 Knipe et al.
5,936,668 A 8/1999 Sawanobori et al.
5,943,158 A 8/1999 Ford et al.
5,945,980 A 8/1999 Moissev et al.
5,952,990 A 9/1999 Inoue et al.
5,986,796 A 11/1999 Miles
6,028,690 A 2/2000 Carter et al.
6,038,056 A 3/2000 Florence et al.
6,040,937 A 3/2000 Miles
6,049,317 A 4/2000 Thompson et al.
6,055,090 A 4/2000 Miles
6,061,075 A 5/2000 Nelson et al.
6,099,132 A 8/2000 Kaeriyama
6,100,872 A 8/2000 Aratani et al.
6,113,239 A 9/2000 Sampsell et al.
6,147,790 A 11/2000 Meier et al.
6,160,833 A 12/2000 Floyd et al.
6,180,428 B1 1/2001 Peeters et al.
6,201,633 B1 * 3/2001 Peeters et al. ..... 359/296
6,222,511 B1 4/2001 Stoller et al.
6,232,936 B1 5/2001 Gove et al.
6,242,989 B1 6/2001 Barber et al.
6,243,149 B1 6/2001 Swanson et al.
6,275,220 B1 8/2001 Nitta
6,282,010 B1 8/2001 Sulzbach et al.
6,295,048 B1 9/2001 Ward et al.
6,295,154 B1 9/2001 Laor et al.
6,304,297 B1 10/2001 Swan
6,307,194 B1 10/2001 Fitzgibbons et al.
6,323,982 B1 11/2001 Hornbeck
6,329,973 B1 12/2001 Akimoto et al.
6,339,417 B1 1/2002 Quanrud
6,395,863 B2 5/2002 Geaghan
6,424,094 B1 7/2002 Feldman
6,447,126 B1 9/2002 Hornbeck
6,465,355 B1 10/2002 Horsley
6,466,354 B1 10/2002 Gudeman
6,466,358 B2 10/2002 Tew
6,473,072 B1 10/2002 Comiskey et al.
6,473,274 B1 10/2002 Maimone et al.
6,480,177 B2 11/2002 Doherty et al.
6,484,011 B1 11/2002 Thompson et al.
6,496,122 B2 12/2002 Sampsell
6,522,794 B1 2/2003 Bischel et al.
6,545,335 B1 4/2003 Chua et al.
6,548,908 B2 4/2003 Chua et al.
6,549,195 B2 4/2003 Hikida et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles et al.
6,680,792 B2 1/2004 Miles
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,747,800 B1 6/2004 Lin
6,762,873 B1 7/2004 Coker et al.
6,775,174 B2 8/2004 Huffman et al.
6,778,155 B2 8/2004 Doherty et al.
6,794,119 B2 9/2004 Miles
6,811,267 B1 11/2004 Allen et al.
6,819,469 B1 11/2004 Koba
6,822,628 B2 11/2004 Dunphy et al.
6,829,132 B2 12/2004 Martin et al.
6,853,129 B1 2/2005 Cummings et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,867,896 B2 3/2005 Miles
6,870,581 B2 3/2005 Li et al.
6,870,654 B2 3/2005 Lin et al.
6,882,458 B2 4/2005 Lin et al.
6,882,461 B1 4/2005 Tsai et al.
6,912,022 B2 6/2005 Lin et al.
6,952,303 B2 10/2005 Lin et al.
6,958,847 B2 10/2005 Lin
7,123,216 B1 10/2006 Miles
7,138,984 B1 11/2006 Miles
7,280,265 B2 10/2007 Miles
2001/0003487 A1 6/2001 Miles
2001/0040538 A1 11/2001 Quanrud
2001/0050666 A1 12/2001 Huang et al.

| | | | |
|---|---|---|---|
| 2002/0012159 | A1 | 1/2002 | Tew |
| 2002/0015215 | A1 | 2/2002 | Miles |
| 2002/0024711 | A1 | 2/2002 | Miles |
| 2002/0041264 | A1 | 4/2002 | Quanrud |
| 2002/0054424 | A1 | 5/2002 | Miles |
| 2002/0075555 | A1 | 6/2002 | Miles |
| 2002/0126364 | A1 | 9/2002 | Miles |
| 2002/0149828 | A1 | 10/2002 | Miles |
| 2002/0171610 | A1 | 11/2002 | Siwinski et al. |
| 2002/0175284 | A1 | 11/2002 | Vilain |
| 2002/0181208 | A1 | 12/2002 | Credelle et al. |
| 2002/0186209 | A1 | 12/2002 | Cok |
| 2003/0004272 | A1 | 1/2003 | Power |
| 2003/0043157 | A1 | 3/2003 | Miles |
| 2003/0072070 | A1 | 4/2003 | Miles |
| 2003/0107805 | A1 | 6/2003 | Street |
| 2003/0112507 | A1 | 6/2003 | Divelbiss et al. |
| 2003/0117382 | A1 | 6/2003 | Pawlowski et al. |
| 2003/0122773 | A1 | 7/2003 | Washio |
| 2003/0128197 | A1 | 7/2003 | Turner et al. |
| 2003/0141453 | A1 | 7/2003 | Reed et al. |
| 2003/0173504 | A1 | 9/2003 | Cole et al. |
| 2003/0202264 | A1 | 10/2003 | Weber et al. |
| 2003/0202265 | A1 | 10/2003 | Reboa et al. |
| 2003/0202266 | A1 | 10/2003 | Ring et al. |
| 2004/0024580 | A1 | 2/2004 | Salmonsen et al. |
| 2004/0027324 | A1 | 2/2004 | Furuhashi et al. |
| 2004/0051929 | A1 | 3/2004 | Sampsell et al. |
| 2004/0058532 | A1 | 3/2004 | Miles et al. |
| 2004/0080807 | A1 | 4/2004 | Chen et al. |
| 2004/0125281 | A1 | 7/2004 | Lin et al. |
| 2004/0145049 | A1 | 7/2004 | McKinnell et al. |
| 2004/0145811 | A1 | 7/2004 | Lin et al. |
| 2004/0147056 | A1 | 7/2004 | McKinnell et al. |
| 2004/0147198 | A1 | 7/2004 | Lin et al. |
| 2004/0150939 | A1 | 8/2004 | Huff |
| 2004/0160143 | A1 | 8/2004 | Shreeve et al. |
| 2004/0174583 | A1 | 9/2004 | Chen et al. |
| 2004/0175577 | A1 | 9/2004 | Lin et al. |
| 2004/0179281 | A1 | 9/2004 | Reboa |
| 2004/0207897 | A1 | 10/2004 | Lin |
| 2004/0209192 | A1 | 10/2004 | Lin et al. |
| 2004/0209195 | A1 | 10/2004 | Lin |
| 2004/0212026 | A1 | 10/2004 | Van Brocklin et al. |
| 2004/0217378 | A1 | 11/2004 | Martin et al. |
| 2004/0217919 | A1 | 11/2004 | Pichl et al. |
| 2004/0218251 | A1 | 11/2004 | Piehl et al. |
| 2004/0218334 | A1 | 11/2004 | Martin et al. |
| 2004/0218341 | A1 | 11/2004 | Martin et al. |
| 2004/0227493 | A1 | 11/2004 | Van Brocklin et al. |
| 2004/0240032 | A1 | 12/2004 | Miles |
| 2004/0240138 | A1 | 12/2004 | Martin et al. |
| 2004/0245588 | A1 | 12/2004 | Nikkel et al. |
| 2004/0263944 | A1 | 12/2004 | Miles et al. |
| 2005/0001828 | A1 | 1/2005 | Martin et al. |
| 2005/0002082 | A1 | 1/2005 | Miles |
| 2005/0003667 | A1 | 1/2005 | Lin et al. |
| 2005/0017177 | A1 | 1/2005 | Tai et al. |
| 2005/0017942 | A1 | 1/2005 | Tsujino et al. |
| 2005/0024557 | A1 | 2/2005 | Lin |
| 2005/0035699 | A1 | 2/2005 | Tsai |
| 2005/0036095 | A1 | 2/2005 | Yeh et al. |
| 2005/0036192 | A1 | 2/2005 | Lin et al. |
| 2005/0038950 | A1 | 2/2005 | Adelmann |
| 2005/0042117 | A1 | 2/2005 | Lin |
| 2005/0046922 | A1 | 3/2005 | Lin et al. |
| 2005/0046948 | A1 | 3/2005 | Lin |
| 2005/0057442 | A1 | 3/2005 | Way |
| 2005/0068583 | A1 | 3/2005 | Gutkowski et al. |
| 2005/0068605 | A1 | 3/2005 | Tsai |
| 2005/0068606 | A1 | 3/2005 | Tsai |
| 2005/0069209 | A1 | 3/2005 | Damera-Venkata et al. |
| 2005/0078348 | A1 | 4/2005 | Lin |
| 2005/0168849 | A1 | 8/2005 | Lin |
| 2005/0195462 | A1 | 9/2005 | Lin |
| 2005/0202649 | A1 | 9/2005 | Hung et al. |
| 2005/0219272 | A1 | 10/2005 | Johnson et al. |
| 2005/0253820 | A1 | 11/2005 | Horiuchi |
| 2007/0132843 | A1 | 6/2007 | Miles |
| 2007/0285385 | A1* | 12/2007 | Albert et al. ..... 345/107 |

FOREIGN PATENT DOCUMENTS

| | | | |
|---|---|---|---|
| EP | 0 584 358 | | 3/1994 |
| EP | 0 602 623 | | 6/1994 |
| EP | 0608056 | A1 | 7/1994 |
| EP | 0667548 | | 8/1995 |
| EP | 0 725 380 | | 8/1996 |
| EP | 0986077 | A2 | 3/2000 |
| EP | 1067805 | A2 | 1/2001 |
| EP | 1 134 721 | | 9/2001 |
| JP | 56-092494 | | 7/1981 |
| JP | 157313 | | 5/1991 |
| JP | 3109524 | A | 5/1991 |
| JP | 405275401 | | 10/1993 |
| JP | 07-005860 | | 1/1994 |
| JP | 10161630 | A | 6/1998 |
| JP | 2000-112435 | | 4/2000 |
| JP | 2000-352943 | | 5/2000 |
| JP | 2001-222276 | | 8/2001 |
| JP | 2001-242818 | | 9/2001 |
| JP | 2003-248468 | | 9/2003 |
| JP | 2003-330433 | | 11/2003 |
| WO | WO 94/29840 | A1 | 12/1994 |
| WO | WO 95/30924 | | 11/1995 |
| WO | WO 97/11447 | | 3/1997 |
| WO | WO 97/17628 | | 5/1997 |
| WO | WO 00/25169 | | 5/1999 |
| WO | WO 99/52006 | A2 | 10/1999 |
| WO | WO 99/52006 | A3 | 10/1999 |
| WO | WO 00/41161 | | 7/2000 |
| WO | WO 02/063602 | A1 | 8/2002 |
| WO | WO 03/007049 | A1 | 1/2003 |
| WO | WO 03/069413 | A1 | 8/2003 |
| WO | WO 03/073151 | A1 | 9/2003 |
| WO | WO 2004/006003 | A1 | 1/2004 |
| WO | WO 2004/026757 | A2 | 4/2004 |
| WO | WO 04/066254 | | 8/2004 |
| WO | WO 04/066256 | | 8/2004 |
| WO | WO 2004/075526 | A2 | 9/2004 |
| WO | WO 2004/095409 | | 11/2004 |
| WO | WO 2005/066596 | | 7/2005 |

OTHER PUBLICATIONS

Aratani et al., "Process and Design Considerations for Surface Micromachined Beams for a Tuneable Interferometer Array in Silicon," Proc. IEEE Microelectromechanical Workshop, Fort Lauderdale, FL, pp. 230-235 (Feb. 1993).

Aratani et al., "Surface Micromachined Tuneable Interferometer Array," Sensors and Actuators, pp. 17-23 (1994).

Billard, C.; "Tunable Capacitor," 5h Annual Review of LETI, Jun. 24, 2003, p. 7.

Bouchaud, Jeremie; Wicht, Henning; "RF Memes Analysis, Forecasts and Technology Review," Chip Unaxis, date unknown, [online] retrieved from the Internet: <URL:http://semiconductors.unaxis.com/en/download/RF%20MEMS.pdf>.

Chan et al., "Low-Actuation Voltage RF MEMS Shunt Switch With Cold Switching Lifetime of Seven Billion Cycles," Journal of Microelectromechanical Systems vol. 12, No. 5 (Oct. 2003).

Conner, "Hybrid Color Display Using Optical Interference Filter Array," SID Digest, pp. 577-580 (1993).

De Coster et al., "Variable RF MEMS Capacitors With Extended Tuning Range", IEEE International Solid-State Sensors and Actuators Conference, Boston, (Jun. 8-12, 2003).

Goossen et al., "Possible Display Applications of the Silicon Mechanical Anti-Reflection Switch," Society for Information Display (1994).
Goossen et al., "Silicon Modulator Based on Mechanically-Active Anti-Reflection Layer with 1Mbit/sec Capability for Fiber-in-the-Loop Applications," IEEE Photonics Technology Letters (Sep. 1994).
Gosch, "West Germany Grabs the Lead in X-Ray Lithography," Electronics, pp. 78-80 (Feb. 5, 1987).
Heines et al, "Bi-Stable Flat-Panel Display Based on a 180 [DEG.] Flipping Pixel", Conference: Displays IX: Displays for Defense Applications, (Apr. 2-5, 2002), Proceedings of the SPIE: The International Society for Optical Engineering, vol. 4712, pp. 327-335.
Howard et al., "Nanometer-Scale Fabrication Techniques," VLSI Electronics: Microstructure Science, vol. 5, pp. 145-153 and pp. 166-173 (1982).
Jackson, "Classical Electrodynamics," John Wiley & Sons Inc., pp. 568-573 (date unknown).
Jerman et al., "A Miniature Fabry-Perot Interferometer with a Corrugated Silicon Diaphragm Support," IEEE Electron Devices Society (1988).
Johnson "Optical Scanners," Microwave Scanning Antennas, vol. 1, pp. 251-261 (1964).
Li, G.P. "On the design and Fabrication of Electrostatic RF MEMS Switches," Final Report 1999-00 for Micro Project 99-071, University of California, Irvine.
Light over Matter, Circle No. 36 (Jun. 1993).
Mait, "Design of Diffractive Optical Elements for Optical Signal Processing", IEEE Lasers and Electro-Optics Society Annual Meeting, pp. 59-60, (Nov. 15-18, 1993).
Miles, "A New Reflective FPD Technology Using Interferometric Modulation," Society for Information Display '97 Digest, Session 7.3.
Newsbreaks, "Quantum-trench devices might operate at terahertz frequencies," Laser Focus World (May 1993).
Nieminen, Heikki, Ermolov, Vladimir; Silanto, Samuli; Nybergh, Kjell; Rhanen, Tapani; "Design of a Temperature-Stable RF MEM Capacitor," Institute of Electrical and Electronics Engineers (IEEE) Journal of Microelectromechanical Systems, vol. 13, No. 5, Oct. 2004, pp. 705-714.
Oliner et al., "Radiating Elements and Mutual Coupling," Microwave Scanning Antennas, vol. 2, p. 131-194 (1966).
Oz et al., "CMOS-Compatible RF-MEMS Tunable Capacitors", IEEE MTT-S International Microwave Symposium—IMS 2003, (Jun. 8-13, 2003).
Pacheco et al. "Design of Low Actuation Voltage RF MEMS Switch" Radiation Laboratory and Center for Microsystems Department of Electrical Engineering and Computer Science University of Michigan, IEEE (2000) 0-7803-5687-X/00/.
Raley et al., "A Fabry-Perot Microinterferometer for Visible Wavelengths," IEEE Solid-State Sensor and Actuator Workshop, Hilton Head, SC (1992).
Solgaard et al., "Interference-Based Optical MEMS Filters", Optical 2004 Fiber Communication Conference, vol. 1, (Feb. 23-27, 2004).
Sperger et al., "High Performance Patterned All-Dielectric Interference Colour Filter for Display Applications," SID Digest, pp. 81-83 (1994).
Stone, "Radiation and Optics, An Introduction to the Classical Theory," McGraw-Hill, pp. 340-343 (1963).
Tan et al. "RF MEMS Simulation-High Isolation CPW Shunt Switches", Ansoft: Global Seminars: Delivering Performance (2003).
Vähä-Heikkilä et al. "Design of Capacitive RF MEMS Power Sensor" VTT Information Technology, (2002), available at <http://www.hut.fi/Units/Radio/URSI02/ursi_vaha-heikkila.pdf>.
Walker, et al., "Electron-beam-tunable Interference Filter Spatial Light Modulator," Optics Letters vol. 13, No. 5, pp. 345-347 (May 1988).
Wang et al., "Design and Fabrication of a Novel Two-Dimension MEMS-Based Tunable Capacitor", IEEE 2002 International Conference on Communications, Circuits and Systems and West Sino Expositions, vol. 2, pp. 1766-1769, (Jun. 29-Jul. 1, 2002).
Winton, John M., "A novel way to capture solar energy," Chemical Week, pp. 17-18 (May 15, 1985).
Wu, "Design of a Reflective Color LCD Using Optical Interference Reflectors," ASIA Display '95, pp. 929-931 (Oct. 16, 1995).
Bass, "Handbook of Optics, vol. I, Fundamentals, Techniques, and Design, Second Edition," McGraw-Hill, Inc., New York, pp. 2.29-2.36 (1995).
Ibotson, et al. "Comparison of XeF2, and F-atom reactions with Si and Si02, Applied Physics Letters." vol. 44, No. 12, Jun. 1984. pp. 1129-1131.
Schnakenberg, et al. "THAHW Etchants for Silicon Micromachining." 1991 International Conference on Solid State Sensors and Actuators—Digest of Technical Papers. pp. 815-818.
Williams, et al. Etch Rates for Michromachining Processing—Journal of Microelectromechanical Systems. vol. 5 No. 4, Dec. 1996, pp. 256-269.
Winters, et al., "The Etching of Silicon with XeF2 Vapor." Applied Physics Letters, vol. 34. No. 1, Jan. 1979, pp. 70-73.
Austrian Search Report from U.S. Appl. No. 11/097,509, filed Jul. 14, 2005.
Austrian Search Report from U.S. Appl. No. 11/097,509, filed Jul. 29, 2005.
Austrian Search Report from U.S. Appl. No. 11/096,546, filed May 19, 2005.
Austrian Search Report from U.S. Appl. No. 11/140,560, filed Aug. 11, 2005.
Austrian Search Report from U.S. Appl. No. 11/066,724, filed May 13, 2005.
Austrian Search Report from U.S. Appl. No. 11/097,818, filed Jul. 14, 2005.
Austrian Search Report from U.S. Appl. No. 11/097,820, filed Jun. 29, 2005.
Mark W. Miles, "MEMS-based interferometric modulator for display applications," Proceedings of SPIE, vol. 3876, Aug. 1999, pp. 20-28.
Miles et al., 10.1: Digital PaperTM for reflective displays, SID 02 Digest, pp. 115-117, 2002.
NEC Corporation, MOS Integrated Circuit μPD16180, Preliminary Product Information, Apr. 2003.
Sato et al. A .9 m-pixel poly-Si TFT-LDC for HD and computer-data projectors, IEEE Transactions on Consumer Electronics, 41(4):1181-1187, Nov. 1995.
Partial European Search Report for App. No. 05255666.9, dated Jul. 9, 2008.
Office Action received Aug. 20, 2008 in Chinese App. No. 200510103446.8.
Extended European Search Report for App. No. 05255666.9, dated Sep. 26, 2008, Docket No. Irdm.107VEP.
Notice of Reasons for Rejection dated Jan. 27, 2009 in Japanese App. No. 2005-216693.

* cited by examiner

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

CONTROLLER AND DRIVER FEATURES FOR BI-STABLE DISPLAY

CROSS REFERENCE TO RELATED APPLICATIONS

This application claims priority to U.S. Provisional Application No. 60/613,412, titled "Controller And Driver Features For Bi-Stable Display," filed Sep. 27, 2004, which is incorporated by reference, in its entirety. This application is related to U.S. Provisional Application No. 60/613,573 titled "System Having Different Update Rates For Different Portions Of A Partitioned Display," filed Sep. 27, 2004, U.S. Provisional Application No. 60/613,407 titled "Method And System For Server Controlled Display Partitioning And Refresh Rate," filed Sep. 27, 2004, U.S. Provisional Application No. 60/614,360 titled "System With Server Based Control Of Client Display Features," filed Sep. 27, 2004, U.S. application Ser. No. 11/097,819 titled "Controller and Driver Features for Bi-Stable Display," filed on even date herewith, U.S. application Ser. No. 11/096,547 titled "Method And System For Driving a Bi-stable Display," filed on even date herewith, U.S. application Ser. No. 11/097,509 titled "System With Server Based Control Of Client Device Display Features," filed on even date herewith, U.S. application Ser. No. 11/097,820 titled "System and Method of Transmitting Video Data," filed on even date herewith, and U.S. application Ser. No. 11/097,818 titled "System and Method of Transmitting Video Data," filed on even date herewith, all of which are incorporated herein by reference and assigned to the assignee of the present invention.

BACKGROUND

1. Field of the Invention

The field of the invention relates to microelectromechanical systems (MEMS).

2. Description of the Related Technology

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

A first embodiment includes a display system, comprising at least one driving circuit configured to provide signals for displaying video data, and a display comprising an array having a plurality of bi-stable display elements, the array being configured to display video data using signals received from the driving circuit, the array is partitioned into one or more fields, each field including at least one bi-stable display element and the driving circuit is configured to refresh each of the one or more fields in accordance with a refresh rate associated with each field. In one aspect of the first embodiment, the driving circuit is configured to partition the array. In a second aspect, an input device is configured to receive a user selection, and the driving circuit is configured to partition the array based on the user selection. In a third aspect, the array is partitioned by a server in communication with the display system. In a fourth aspect, the plurality of bi-stable display elements comprise interferometric modulators, and wherein the array is partitioned into one or more fields comprising a first field comprising a first set of interferometric modulators and a second field comprising a second set of interferometric modulators. In a fifth aspect, the driving circuit is configured to receive at least a portion of the video data from a server in communication with the display system. In a sixth aspect, the first set of interferometric modulators is refreshed at a first refresh rate and the second set of interferometric modulators is refreshed at a second refresh rate. In a seventh aspect, at least one interferometric modulator of the first set of interferometric modulators is also an interferometric modulator of the second set of interferometric modulators. In an eighth aspect, the first set of interferometric modulators is arranged in the shape of a polygon. In a ninth aspect, the at least one interferometric modulator is refreshed with the first set of interferometric modulators during a first refresh cycle and the at least one interferometric modulator is refreshed with the second set of interferometric modulators during a second refresh cycle. In a tenth aspect, the second refresh rate is different than the first refresh rate. In an eleventh aspect, the second refresh rate is the same as the first refresh rate, and refresh of the first field starts at a different time than the refresh of the second field. In a twelfth aspect, the first refresh rate is determined based at least in part on a frame rate of the data that is displayed in the first field. In thirteenth aspect, the first refresh rate is predetermined. In a fourteenth aspect, the first refresh rate changes over time.

A second embodiment includes a method of displaying data on a display of a client device, the method comprising partitioning a bi-stable display of the client device into two or more fields, displaying video data in the two or more fields, and refreshing each of the two or more fields in accordance with a refresh rate that is associated with each of the two or more fields. The bi-stable display can include an array of interferometric modulators. This embodiment can further include receiving at least a portion of the video data from a server. Also, this method can include updating one or more fields using one or more update schemes. At least one of the one or more update scheme can be selected using a program associated with the received data. In this embodiment, refreshing at least one of the two or more fields can comprise using a refresh rate that is based on a frame rate of the data that is displayed. The method can further include receiving display information comprising a characteristic of the display, and selecting an update scheme using the display information.

A third embodiment includes a communications system for server-based control of a display on a client device, comprising a communications network, a client device comprising a bi-stable display having a plurality of bi-stable display elements, the client device being configured to transmit display information, for example, one or more characteristics of the bi-stable display, over the communications network, and a server configured to define one or more fields of the bi-stable display, each field having an associated refresh rate, and the server further configured to transmit video data to the client device over the communications network based on the display information, wherein the client device is further configured to receive video data from the server, to display the video data on the one of more fields of the display, and to update each field using the associated refresh information. In one aspect, the display information includes a display mode. In a second aspect, the display information indicates where the video data should be rendered on the bi-stable display. In a third aspect, the server can be further configured to identify video data to be displayed in each of the two or more fields.

A fourth embodiment includes a data display system, comprising a content server, and a client device in data communication with the content server, the client device comprising a bi-stable display that is configurable to display data in one or more fields, each field being associated with at least one bi-stable display element, wherein each field of the bi-stable display can be refreshed at its own refresh rate. In one aspect, the data display system can have one of more fields that are separately addressable by the content server. In a second aspect, the content server can include a processor and a software module, the software module being associated with the received data. In a third aspect, the client device can be configured to communicate characteristics of the display to the content server. In a fourth aspect, the one or more fields can comprise a first field and a second field, wherein the bi-stable display comprises a first set of interferometric modulators and a second set of interferometric modulators, the first set of interferometric modulators being associated with the first field and the second set of interferometric modulators being associated with the second field. In a fifth aspect, the display system can have at least one interferometric modulator from the first set of interferometric modulators is assigned to the first plurality of interferometric modulators and to the second set of interferometric modulators. In a sixth aspect, the first field can be configured to update at a first refresh rate and the second field is configured to update at a second refresh rate. In a seventh aspect, the server is further configured to source video data to be displayed in each of the one or more fields of the bi-stable display of the client device.

DETAILED DESCRIPTION OF CERTAIN EMBODIMENTS

Figure 1:
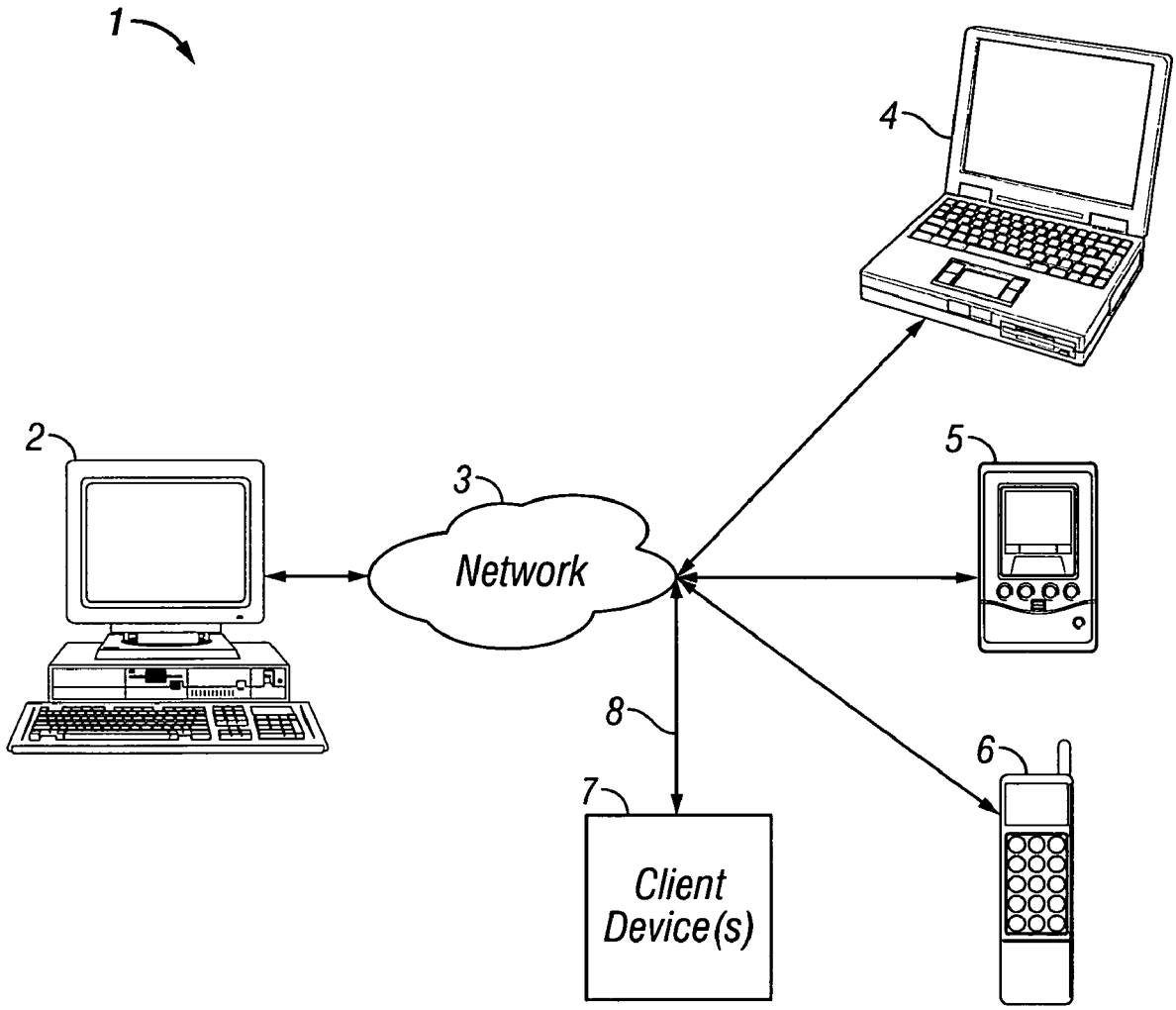
FIG. 1 illustrates a networked system of one embodiment.

The following detailed description is directed to certain specific embodiments. However, the invention can be embodied in a multitude of different ways. Reference in this specification to "one embodiment" or "an embodiment" means that a particular feature, structure, or characteristic described in connection with the embodiment is included in at least one embodiment. The appearances of the phrase "in one embodiment," "according to one embodiment," or "in some embodiments" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In one embodiment, a display array on a device includes at least one driving circuit and an array of means, e.g., interferometric modulators, on which video data is displayed. Video data, as used herein, refers to any kind of displayable data, including pictures, graphics, and words, displayable in either static or dynamic images (for example, a series of video frames that when viewed give the appearance of movement, e.g., a continuous ever-changing display of stock quotes, a "video clip", or data indicating the occurrence of an event of action). Video data, as used herein, also refers to any kind of control data, including instructions on how the video data is to be processed (display mode), such as frame rate, and data format. The array is driven by the driving circuit to display video data.

In one embodiment, an interferometric display is partitioned into two or more fields. Video data can be identified to be displayed in one of the two or more fields, and the video data can be displayed in each of the fields. Refreshing each partition at its own refresh rate can result in power savings for displays that do not require frequent updates. In one embodiment, a partitionable display includes an interferometric modulator array and a driving circuit configured to drive the array, where the driving circuit is configured to partition an array of interferometric modulators into two or more fields, identify data to be displayed in one of the two or more fields, and display the identified data in a corresponding field of the partitioned array, and to update each of the fields of the array at a refresh rate that can be the same or different than the refresh rate of the other fields. In another embodiment, a method of displaying data includes receiving video data, identifying video data to be displayed in the two or more fields, displaying the identified data in a corresponding field of the partitioned array, and updating each partition of the display at a refresh rate dependent on the content of the video data displayed.

In this description, reference is made to the drawings wherein like parts are designated with like numerals throughout. The invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Spatial light modulators used for imaging applications come in many different forms. Transmissive liquid crystal display (LCD) modulators modulate light by controlling the twist and/or alignment of crystalline materials to block or pass light. Reflective spatial light modulators exploit various physical effects to control the amount of light reflected to the imaging surface. Examples of such reflective modulators include reflective LCDs, and digital micromirror devices.

Another example of a spatial light modulator is an interferometric modulator that modulates light by interference. Interferometric modulators are bi-stable display elements which employ a resonant optical cavity having at least one movable or deflectable wall. Constructive interference in the optical cavity determines the color of the viewable light emerging from the cavity. As the movable wall, typically comprised at least partially of metal, moves towards the stationary front surface of the cavity, the interference of light within the cavity is modulated, and that modulation affects the color of light emerging at the front surface of the modulator. The front surface is typically the surface where the image seen by the viewer appears, in the case where the interferometric modulator is a direct-view device.

FIG. 1 illustrates a networked system in accordance with one embodiment. A server 2, such as a Web server is operatively coupled to a network 3. The server 2 can correspond to a Web server, to a cell-phone server, to a wireless e-mail server, and the like. The network 3 can include wired networks, or wireless networks, such as WiFi networks, cell-phone networks, Bluetooth networks, and the like.

The network 3 can be operatively coupled to a broad variety of devices. Examples of devices that can be coupled to the network 3 include a computer such as a laptop computer 4, a personal digital assistant (PDA) 5, which can include wireless handheld devices such as the BlackBerry, a Palm Pilot, a Pocket PC, and the like, and a cell phone 6, such as a Web-enabled cell phone, Smartphone, and the like. Many other devices can be used, such as desk-top PCs, set-top boxes, digital media players, handheld PCs, Global Positioning System (GPS) navigation devices, automotive displays, or other stationary and mobile displays. For convenience of discussion all of these devices are collectively referred to herein as the client device 7.

Figure 2:
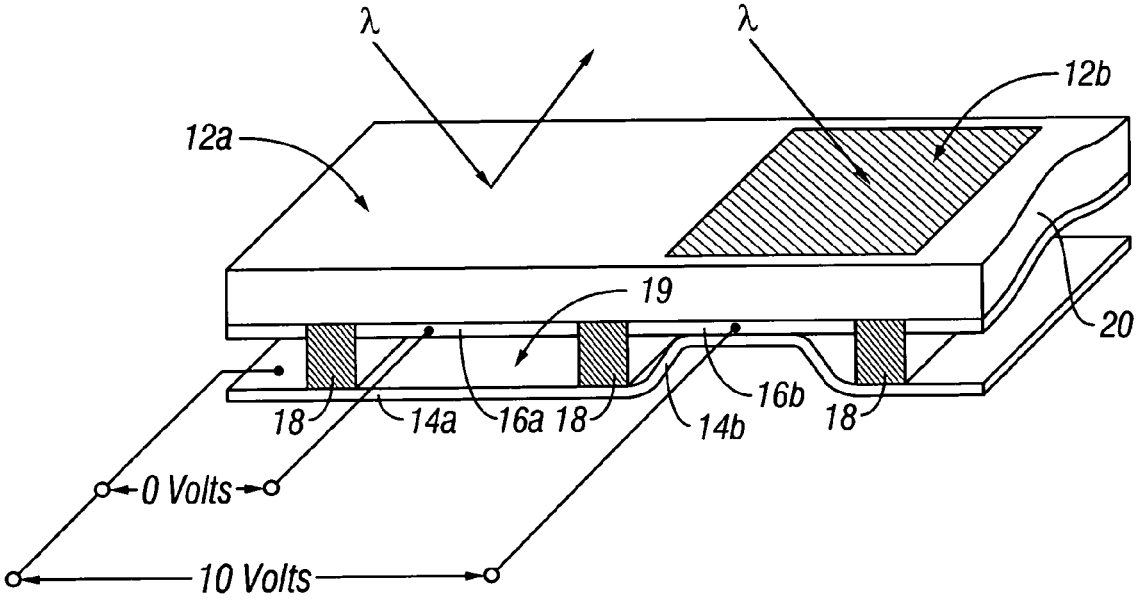
FIG. 2 is an isometric view depicting a portion of one embodiment of an interferometric modulator display array in which a movable reflective layer of a first interferometric modulator is in a released position and a movable reflective layer of a second interferometric modulator is in an actuated position.

One bi-stable display element embodiment comprising an interferometric MEMS display element is illustrated in FIG. 2. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 2 is an isometric view depicting two adjacent pixels in a series of pixels of a visual display array, wherein each pixel comprises a MEMS interferometric modulator. In some embodiments, an interferometric modulator display array comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 2 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The partially reflective layers 16*a*, 16*b* are electrically conductive, partially transparent and fixed, and may be fabricated, for example, by depositing one or more layers each of chromium and indium-tin-oxide onto a transparent substrate 20. The layers are patterned into parallel strips, and may form row electrodes in a display device as described further below. The highly reflective layers 14*a*, 14*b* may be formed as a series of parallel strips of a deposited metal layer or layers (orthogonal to the row electrodes, partially reflective layers 16*a*, 16*b*) deposited on top of supports 18 and an intervening sacrificial material deposited between the supports 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the air gap 19 remains between the layers 14*a*, 16*a* and the deformable layer is in a mechanically relaxed state as illustrated by the interferometric modulator 12*a* in FIG. 2. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the interferometric modulator 12*b* on the right in FIG. 2. The behavior is the same regardless of the polarity of the applied potential difference. In this way, row/column actuation that can control the reflective vs. non-reflective interferometric modulator states is analogous in many ways to that used in conventional LCD and other display technologies.

FIGS. 3 through 5 illustrate an exemplary process and system for using an array of interferometric modulators in a display application. However, the process and system can also be applied to other displays, e.g., plasma, EL, OLED, STN LCD, and TFT LCD.

Currently, available flat panel display controllers and drivers have been designed to work almost exclusively with displays that need to be constantly refreshed. Thus, the image displayed on plasma, EL, OLED, STN LCD, and TFT LCD panels, for example, will disappear in a fraction of a second if not refreshed many times within a second. However, because interferometric modulators of the type described above have the ability to hold their state for a longer period of time without refresh, wherein the state of the interferometric modulators may be maintained in either of two states without refreshing, a display that uses interferometric modulators may be referred to as a bi-stable display. In one embodiment, the state of the pixel elements is maintained by applying a bias voltage, sometimes referred to as a latch voltage, to the one or more interferometric modulators that comprise the pixel element.

In general, a display device typically requires one or more controllers and driver circuits for proper control of the display device. Driver circuits, such as those used to drive LCD's, for example, may be bonded directly to, and situated along the edge of the display panel itself. Alternatively, driver circuits may be mounted on flexible circuit elements connecting the display panel (at its edge) to the rest of an electronic system. In either case, the drivers are typically located at the interface of the display panel and the remainder of the electronic system.

Figure 3A:
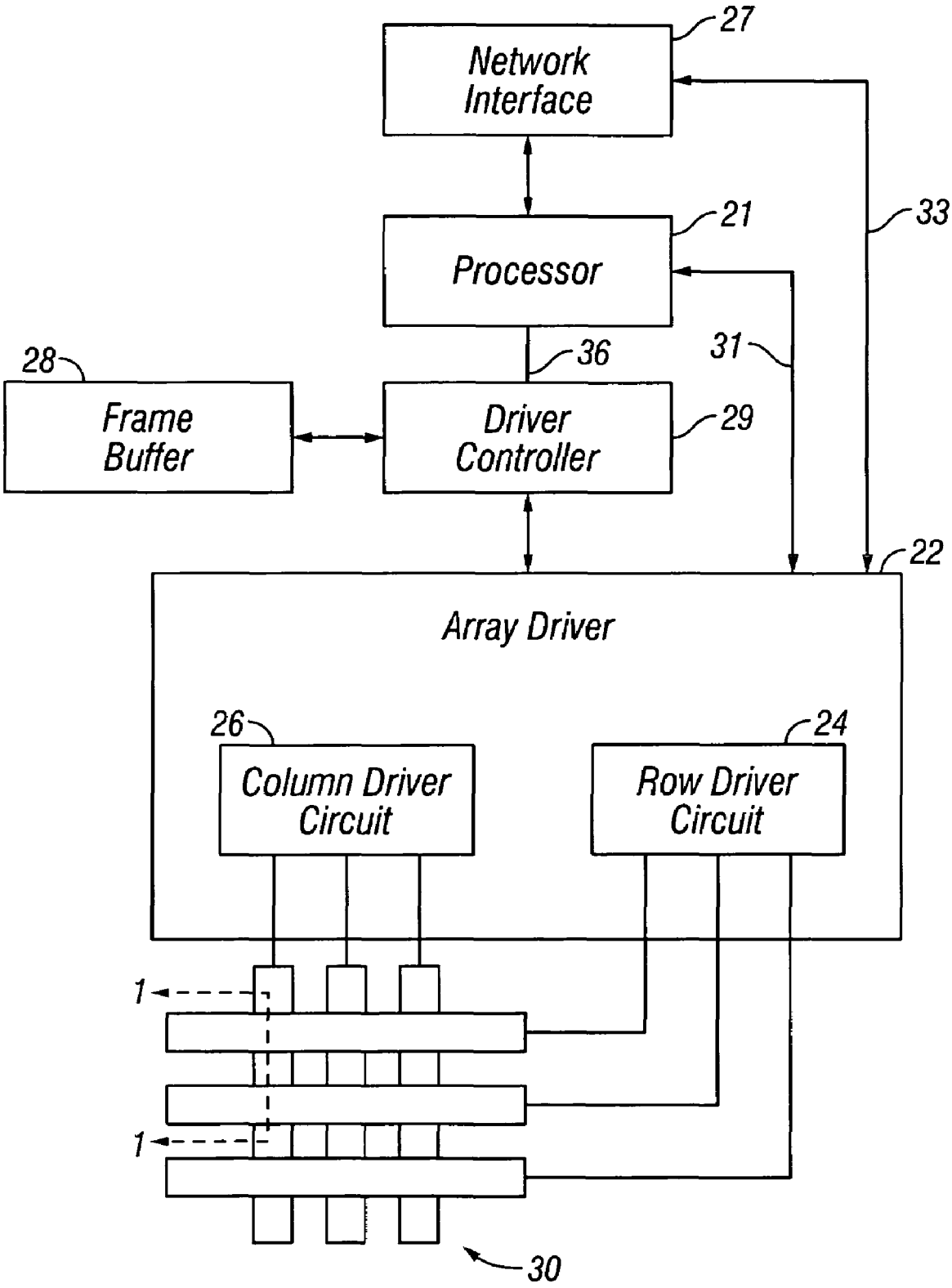
FIG. 3A is a system block diagram illustrating one embodiment of an electronic device incorporating a 3×3 interferometric modulator display array.

FIG. 3A is a system block diagram illustrating some embodiments of an electronic device that can incorporate various aspects. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

FIG. 3A illustrates an embodiment of electronic device that includes a network interface 27 connected to a processor 21 and, according to some embodiments, the network interface can be connected to an array driver 22. The network interface 27 includes the appropriate hardware and software so that the device can interact with another device over a network, for example, the server 2 shown in FIG. 1. The processor 21 is connected to driver controller 29 which is connected to an array driver 22 and to frame buffer 28. In some embodiments, the processor 21 is also connected to the array driver 22. The array driver 22 is connected to and drives the display array 30. The components illustrated in FIG. 3A illustrate a configuration of an interferometric modulator display. However, this configuration can also be used in a LCD with an LCD controller and driver. As illustrated in FIG. 3A, the driver controller 29 is connected to the processor 21 via a parallel bus 36. Although a driver controller 29, such as a LCD controller, is often associated with the system processor 21, as a stand-alone Integrated Circuit (IC), such controllers may be implemented in many ways. They may be embedded in the processor 21 as hardware, embedded in the processor 21 as software, or fully integrated in hardware with the array driver 22. In one embodiment, the driver controller 29 takes the display information generated by the processor 21, reformats that information appropriately for high speed transmission to the display array 30, and sends the formatted information to the array driver 22.

The array driver 22 receives the formatted information from the driver controller 29 and reformats the video data into a parallel set of waveforms that are applied many times per second to the hundreds and sometimes thousands of leads coming from the display's x-y matrix of pixels. The currently available flat panel display controllers and drivers such as those described immediately above have been designed to work almost exclusively with displays that need to be constantly refreshed. Because bi-stable displays (e.g., an array of interferometric modulators) do not require such constant refreshing, features that decrease power requirements may be realized through the use of bi-stable displays. However, if bi-stable displays are operated by the controllers and drivers that are used with current displays the advantages of a bi-stable display may not be optimized. Thus, improved controller and driver systems and methods for use with bi-stable displays are desired. For high speed bi-stable displays, such as the interferometric modulators described above, these improved controllers and drivers preferably implement low-refresh-rate modes, video rate refresh modes, and unique modes to facilitate the unique capabilities of bi-stable modulators. According to the methods and systems described herein, a bi-stable display may be configured to reduce power requirements in various manners.

In one embodiment illustrated by FIG. 3A, the array driver 22 receives video data from the processor 21 via a data link 31 bypassing the driver controller 29. The data link 31 may comprise a serial peripheral interface ("SPI"), $I^2C$ bus, parallel bus, or any other available interface. In one embodiment shown in FIG. 3A, the processor 21 provides instructions to the array driver 22 that allow the array driver 22 to optimize the power requirements of the display array 30 (e.g., an interferometric modulator display). In one embodiment, video data intended for a portion of the display, such as for example defined by the server 2, can be identified by data packet header information and transmitted via the data link 31. In addition, the processor 21 can route primitives, such as graphical primitives, along data link 31 to the array driver 22. These graphical primitives can correspond to instructions such as primitives for drawing shapes and text.

Still referring to FIG. 3A, in one embodiment, video data may be provided from the network interface 27 to the array driver 22 via data link 33. In one embodiment, the network interface 27 analyzes control information that is transmitted from the server 2 and determines whether the incoming video should be routed to either the processor 21 or, alternatively, the array driver 22.

In one embodiment, video data provided by data link 33 is not stored in the frame buffer 28, as is usually the case in many embodiments. It will also be understood that in some embodiments, a second driver controller (not shown) can also be used to render video data for the array driver 22. The data link 33 may comprise a SPI, $I^2C$ bus, or any other available interface. The array driver 22 can also include address decoding, row and column drivers for the display and the like. The network interface 27 can also provide video data directly to the array driver 22 at least partially in response to instructions embedded within the video data provided to the network interface 27. It will be understood by the skilled practitioner that arbiter logic can be used to control access by the network interface 27 and the processor 21 to prevent data collisions at the array driver 22. In one embodiment, a driver executing on the processor 21 controls the timing of data transfer from the network interface 27 to the array driver 22 by permitting the data transfer during time intervals that are typically unused by the processor 21, such as time intervals traditionally used for vertical blanking delays and/or horizontal blanking delays.

Advantageously, this design permits the server 2 to bypass the processor 21 and the driver controller 29, and to directly address a portion of the display array 30. For example, in the illustrated embodiment, this permits the server 2 to directly address a predefined display array area of the display array 30. In one embodiment, the amount of data communicated between the network interface 27 and the array driver 22 is relatively low and is communicated using a serial bus, such as an Inter-Integrated Circuit ($I^2C$) bus or a Serial Peripheral Interface (SPI) bus. It will also be understood, however, that where other types of displays are utilized, that other circuits will typically also be used. The video data provided via data link 33 can advantageously be displayed without a frame buffer 28 and with little or no intervention from the processor 21.

FIG. 3A also illustrates a configuration of a processor 21 coupled to a driver controller 29, such as an interferometric modulator controller. The driver controller 29 is coupled to the array driver 22, which is connected to the display array 30. In this embodiment, the driver controller 29 accounts for the display array 30 optimizations and provides information to the array driver 22 without the need for a separate connection between the array driver 22 and the processor 21. In some embodiments, the processor 21 can be configured to communicate with a driver controller 29, which can include a frame buffer 28 for temporary storage of one or more frames of video data.

As shown in FIG. 3A, in one embodiment the array driver 22 includes a row driver circuit 24 and a column driver circuit 26 that provide signals to a pixel display array 30. The cross section of the array illustrated in FIG. 2 is shown by the lines 1-1 in FIG. 3A. For MEMS interferometric modulators, the row/column actuation protocol may take advantage of a hysteresis property of these devices illustrated in FIG. 4A. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 4A, the movable layer does not release completely until the voltage drops below 2 volts. There is thus a range of voltage, about 3 to 7 V in the example illustrated in FIG. 4A, where there exists a window of applied voltage within which the device is stable in either the released or actuated state. This is referred to herein as the "hysteresis window" or "stability window."

Figures 4A, 4B:
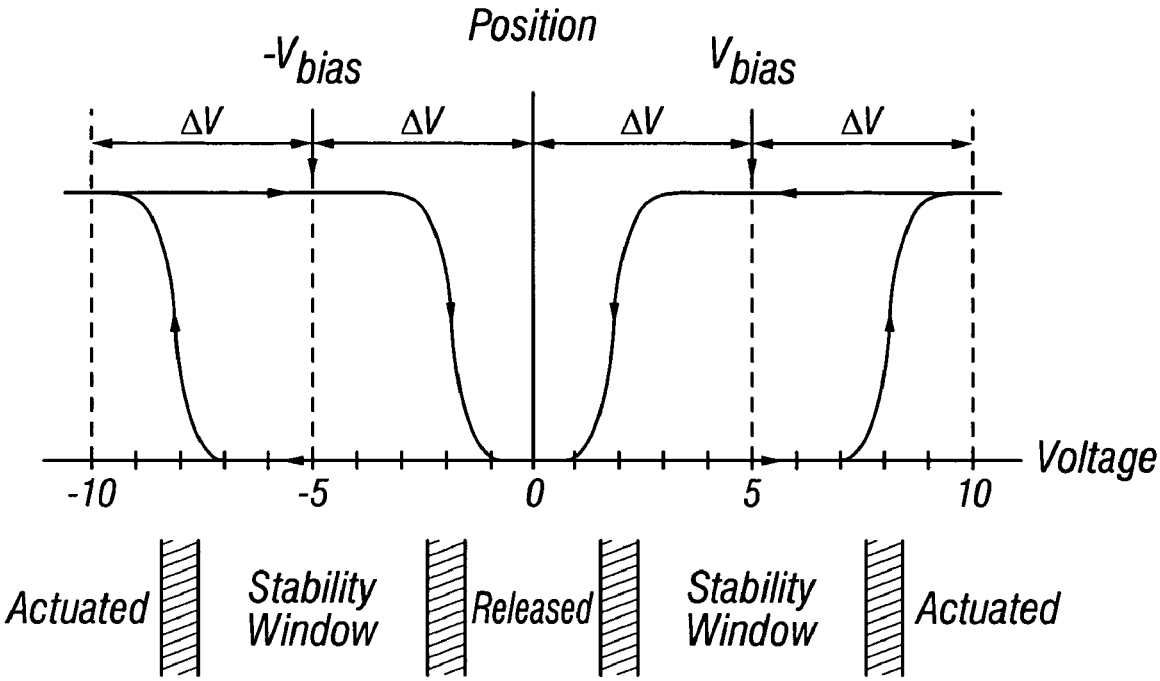
FIG. 4A is a diagram of movable mirror position versus applied voltage for one exemplary embodiment of an interferometric modulator of FIG. 2.
FIG. 4B is an illustration of a set of row and column voltages that may be used to drive an interferometric modulator display array.

For a display array having the hysteresis characteristics of FIG. 4A, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 2 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new video data by continually repeating this process at some desired number of frames per second. A wide variety of protocols for driving row and column electrodes of pixel arrays to produce display array frames are also well known and may be used.

Figure 3B:
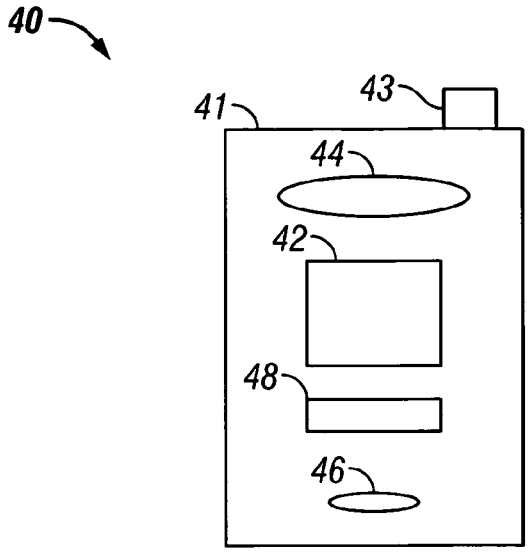
FIG. 3B is an illustration of an embodiment of a client of the server-based wireless network system of FIG. 1.

One embodiment of a client device 7 is illustrated in FIG. 3B. The exemplary client 40 includes a housing 41, a display 42, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 42 of exemplary client 40 may be any of a variety of displays, including a bi-stable display, as described herein with respect to, for example, FIGS. 2, 3A, and 4-6. In other embodiments, the display 42 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 42 includes an interferometric modulator display, as described herein.

Figure 3C:
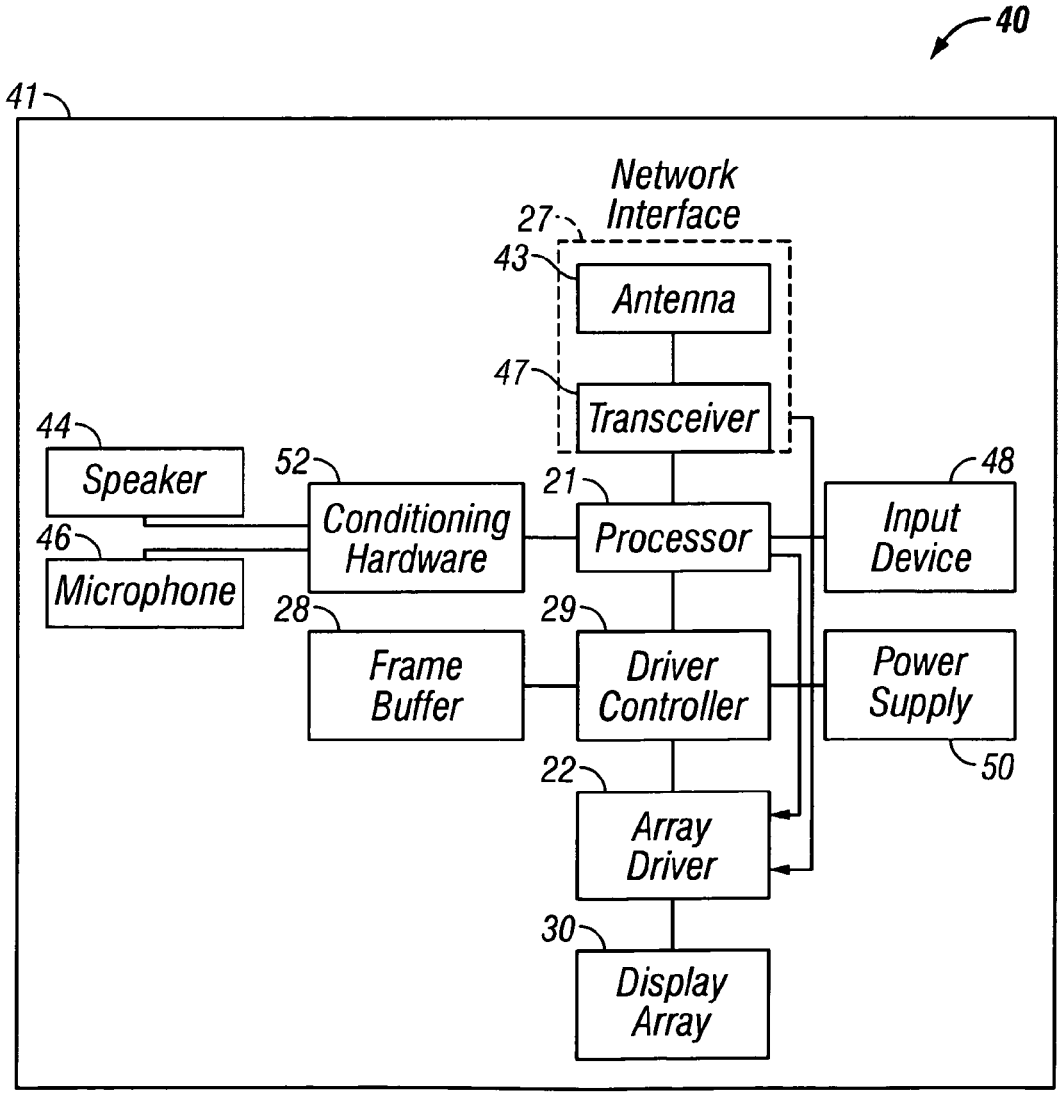
FIG. 3C is an exemplary block diagram configuration of the client in FIG. 3B.

The components of one embodiment of exemplary client 40 are schematically illustrated in FIG. 3C. The illustrated exemplary client 40 includes a housing 41 and can include additional components at least partially enclosed therein. For example, in one embodiment, the client exemplary 40 includes a network interface 27 that includes an antenna 43 which is coupled to a transceiver 47. The transceiver 47 is connected to a processor 21, which is connected to conditioning hardware 52. The conditioning hardware 52 is connected to a speaker 44 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary client 40 design.

The network interface 27 includes the antenna 43, and the transceiver 47 so that the exemplary client 40 can communicate with another device over a network 3, for example, the server 2 shown in FIG. 1. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further processed by the processor 21. The transceiver 47 also processes signals received from the processor 21 so that they may be transmitted from the exemplary client 40 via the antenna 43.

Processor 21 generally controls the overall operation of the exemplary client 40, although operational control may be shared with or given to the server 2 (not shown), as will be described in greater detail below. In one embodiment, the processor 21 includes a microcontroller, CPU, or logic unit to control operation of the exemplary client 40. Conditioning hardware 52 generally includes amplifiers and filters for transmitting signals to the speaker 44, and for receiving signals from the microphone 46. Conditioning hardware 52 may be discrete components within the exemplary client 40, or may be incorporated within the processor 21 or other components.

The input device 48 allows a user to control the operation of the exemplary client 40. In one embodiment, input device 48 includes a keypad, such as a QWERTY keyboard or a telephone keypad, a button, a switch, a touch-sensitive screen, a pressure- or heat-sensitive membrane. In one embodiment, a microphone is an input device for the exemplary client 40. When a microphone is used to input data to the device, voice commands may be provided by a user for controlling operations of the exemplary client 40.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., a interferometric modulator display). In yet another embodiment, display array 30 is a typical display array or a bi-stable display array (e.g., a display including an array of interferometric modulators).

Power supply 50 is any of a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In one embodiment, the array driver 22 contains a register that may be set to a predefined value to indicate that the input video stream is in an interlaced format and should be displayed on the bi-stable display in an interlaced format, without converting the video stream to a progressive scanned format. In this way the bi-stable display does not require interlace-to-progressive scan conversion of interlace video data.

In some implementations control programmability resides, as described above, in a display controller which can be located in several places in the electronic display system. In some cases control programmability resides in the array driver 22 located at the interface between the electronic display system and the display component itself. Those of skill in the art will recognize that the above-described optimization may be implemented in any number of hardware and/or software components and in various configurations.

In one embodiment, circuitry is embedded in the array driver 22 to take advantage of the fact that the output signal set of most graphics controllers includes a signal to delineate the horizontal active area of the display array 30 being addressed. This horizontal active area can be changed via register settings in the driver controller 29. These register settings can be changed by the processor 21. This signal is usually designated as display enable (DE). Most all display video interfaces in addition utilize a line pulse (LP) or a horizontal synchronization (HSYNC) signal, which indicates the end of a line of data. A circuit which counts LPs can determine the vertical position of the current row. When refresh signals are conditioned upon the DE from the processor 21 (signaling for a horizontal region), and upon the LP counter circuit (signaling for a vertical region) an area update function can be implemented.

In one embodiment, a driver controller 29 is integrated with the array driver 22. Such an embodiment is common in highly integrated systems such as cellular phones, watches, and other small area displays. Specialized circuitry within such an integrated array driver 22 first determines which pixels and hence rows require refresh, and only selects those rows that have pixels that have changed to update. With such circuitry, particular rows can be addressed in non-sequential order, on a changing basis depending on image content. This embodiment has the advantage that since only the changed video data needs to be sent through the interface, data rates can be reduced between the processor 21 and the display array 30. Lowering the effective data rate required between processor 21 and array driver 22 improves power consumption, noise immunity and electromagnetic interference issues for the system.

FIGS. 4 and 5 illustrate one possible actuation protocol for creating a display frame on the 3×3 array of FIG. 3. FIG. 4B illustrates a possible set of column and row voltage levels that may be used for pixels exhibiting the hysteresis curves of FIG. 4A. In the FIG. 4A/4B embodiment, actuating a pixel may involve setting the appropriate column to $-V_{bias}$, and the appropriate row to +ΔV, which may correspond to −5 volts and +5 volts respectively. Releasing the pixel may be accomplished by setting the appropriate column to $+V_{bias}$, and the appropriate row to the same +ΔV, producing a zero volt potential difference across the pixel. In those rows where the row voltage is held at zero volts, the pixels are stable in whatever state they were originally in, regardless of whether the column is at $+V_{bias}$, or $-V_{bias}$. Similarly, actuating a pixel may involve setting the appropriate column to $+V_{bias}$, and the appropriate row to −ΔV, which may correspond to 5 volts and −5 volts respectively. Releasing the pixel may be accomplished by setting the appropriate column to $-V_{bias}$, and the appropriate row to the same −ΔV, producing a zero volt potential difference across the pixel. In those rows where the row voltage is held at zero volts, the pixels are stable in whatever state they were originally in, regardless of whether the column is at $+V_{bias}$, or $-V_{bias}$.

Figure 5A:
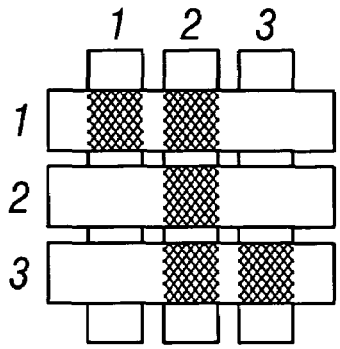
FIGS. 5A and 5B illustrate one exemplary timing diagram for row and column signals that may be used to write a frame of data to the 3×3 interferometric modulator display array of FIG. 3A.
Figure 5B:
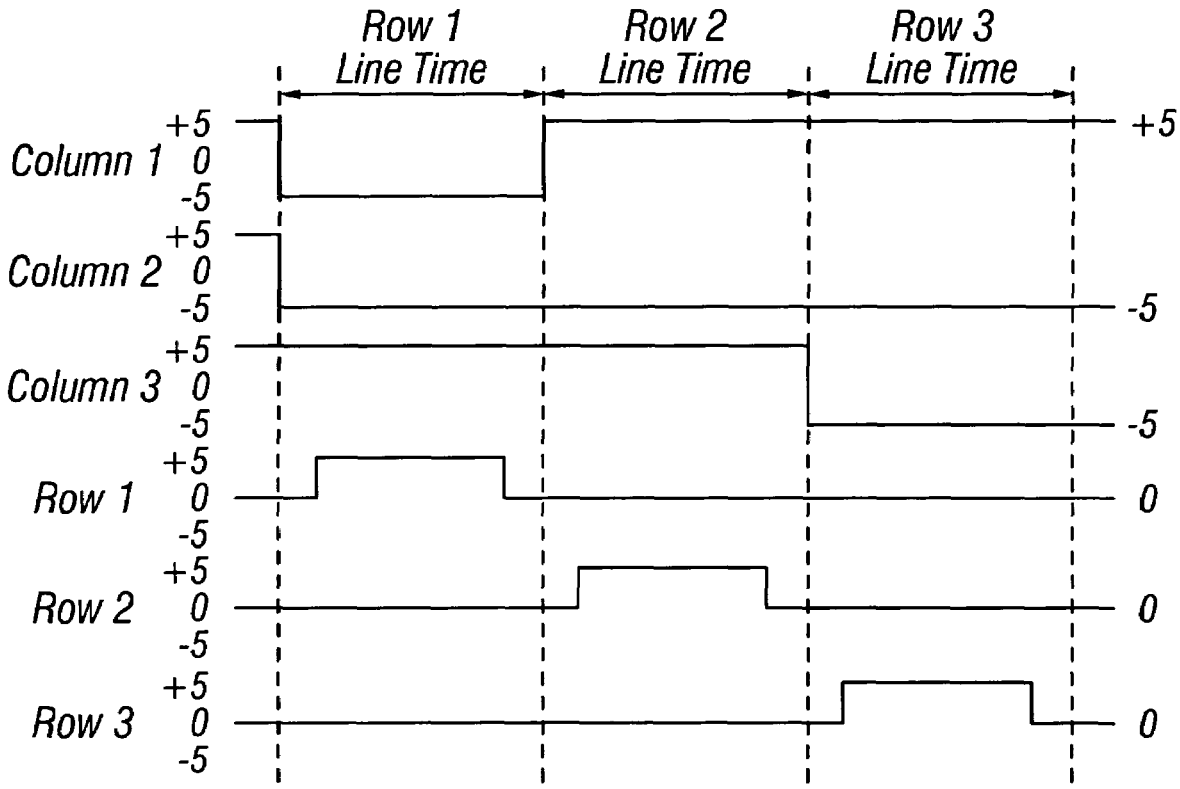

FIG. 5B is a timing diagram showing a series of row and column signals applied to the 3×3 array of FIG. 3A which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used.

Figure 6A:
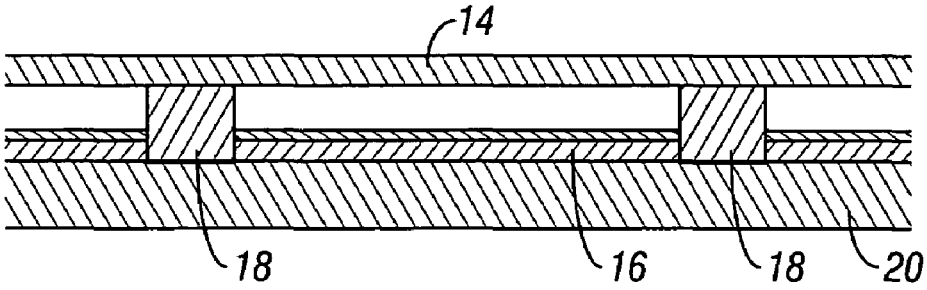
FIG. 6A is a cross section of the interferometric modulator of FIG. 2.
Figure 6B:
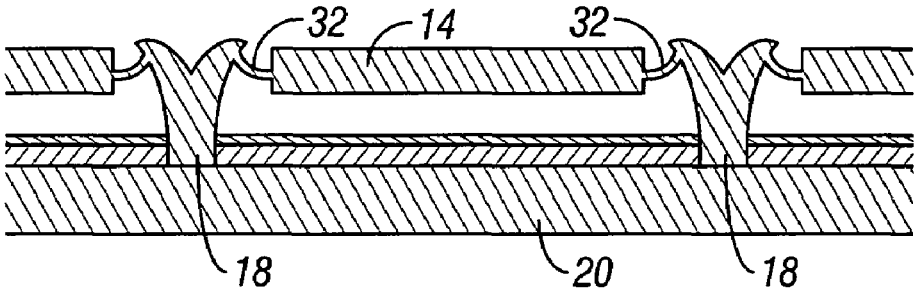
FIG. 6B is a cross section of an alternative embodiment of an interferometric modulator.
Figure 6C:
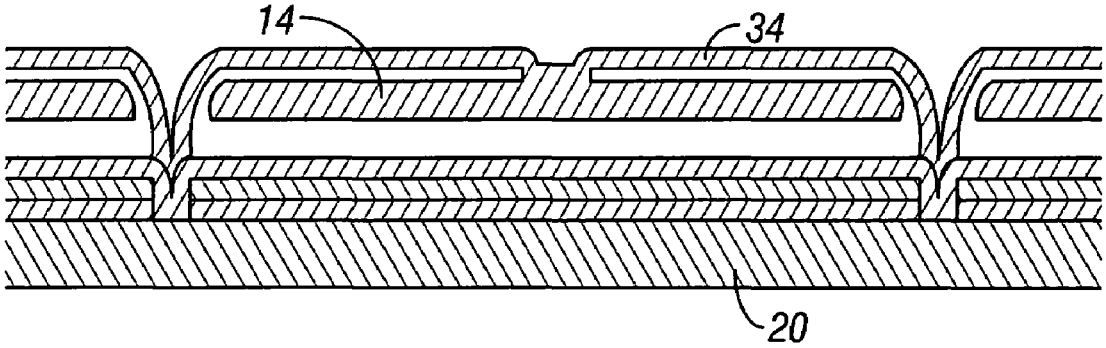
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 2, where a strip of reflective material 14 is deposited on orthogonal supports 18. In FIG. 6B, the reflective material 14 is attached to supports 18 at the corners only, on tethers 32. In FIG. 6C, the reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

Figure 7:
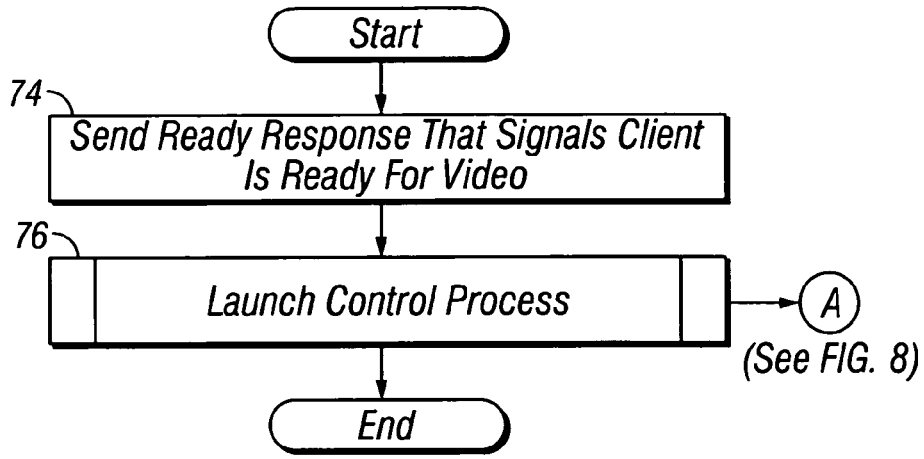
FIG. 7 is a high level flowchart of a client control process.

An embodiment of process flow is illustrated in FIG. 7, which shows a high-level flowchart of a client device 7 control process. This flowchart describes the process used by a client device 7, such as a laptop computer 4, a PDA 5, or a cell phone 6, connected to a network 3, to graphically display video data, received from a server 2 via the network 3. Depending on the embodiment, states of FIG. 7 can be removed, added, or rearranged.

Again referring to FIG. 7, starting at state 74 the client device 7 sends a signal to the server 2 via the network 3 that indicates the client device 7 is ready for video. In one embodiment a user may start the process of FIG. 7 by turning on an electronic device such as a cell phone. Continuing to state 76 the client device 7 launches its control process. An example of launching a control process is discussed further with reference to FIG. 8.

Figure 8:
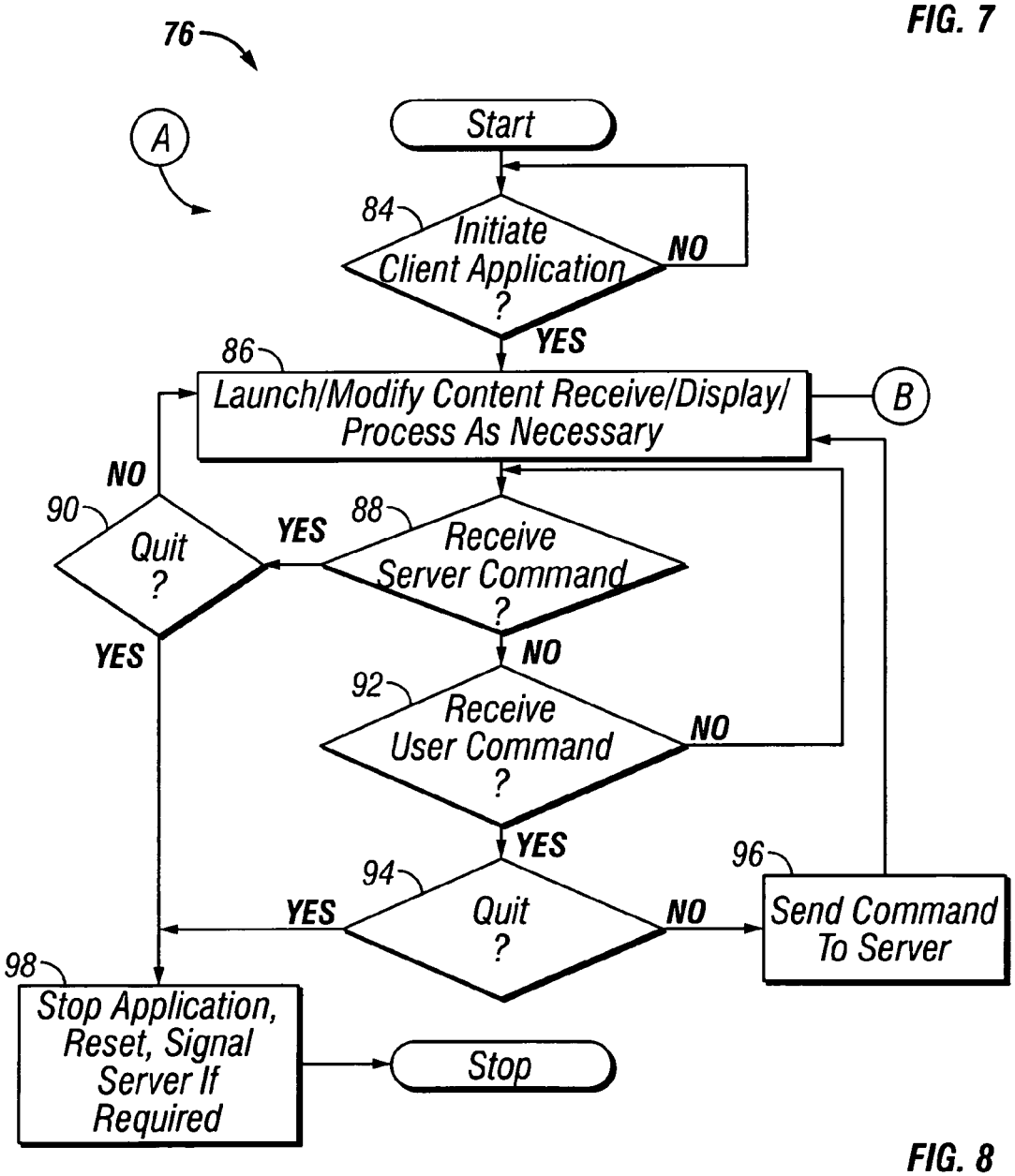
FIG. 8 is a flowchart of a client control process for launching and running a receive/display process.

An embodiment of process flow is illustrated in FIG. 8, which shows a flowchart of a client device 7 control process for launching and running a control process. This flowchart illustrates in further detail state 76 discussed with reference to FIG. 7. Depending on the embodiment, states of FIG. 8 can be removed, added, or rearranged.

Starting at decision state 84, the client device 7 makes a determination whether an action at the client device 7 requires an application at the client device 7 to be started, or whether the server 2 has transmitted an application to the client device 7 for execution, or whether the server 2 has transmitted to the client device 7 a request to execute an application resident at the client device 7. If there is no need to launch an application the client device 7 remains at decision state 84. After starting an application, continuing to state 86, the client device 7 launches a process by which the client device 7 receives and displays video data. The video data may stream from the server 2, or may be downloaded to the client device 7 memory for later access. The video data can be video, or a still image, or textual or pictorial information. The video data can also have various compression encodings, and be interlaced or progressively scanned, and have various and varying refresh rates. The display array 30 may be segmented into regions of arbitrary shape and size, each region receiving video data with characteristics, such as refresh rate or compression encoding, specific only to that region. The regions may change video data characteristics and shape and size. The regions may be opened and closed and re-opened. Along with video data, the client device 7 can also receive control data. The control data can comprise commands from the server 2 to the client device 7 regarding, for example, video data characteristics such as compression encoding, refresh rate, and interlaced or progressively scanned video data. The control data may contain control instructions for segmentation of display array 30, as well as differing instructions for different regions of display array 30.

In one exemplary embodiment, the server 2 sends control and video data to a PDA via a wireless network 3 to produce a continuously updating clock in the upper right corner of the display array 30, a picture slideshow in the upper left corner of the display array 30, a periodically updating score of a ball game along a lower region of the display array 30, and a cloud shaped bubble reminder to buy bread continuously scrolling across the entire display array 30. The video data for the photo slideshow are downloaded and reside in the PDA memory, and they are in an interlaced format. The clock and the ball game video data stream text from the server 2. The reminder is text with a graphic and is in a progressively scanned format. It is appreciated that here presented is only an exemplary embodiment. Other embodiments are possible and are encompassed by state 86 and fall within the scope of this discussion.

Continuing to decision state 88, the client device 7 looks for a command from the server 2, such as a command to relocate a region of the display array 30, a command to change the refresh rate for a region of the display array 30, or a command to quit. Upon receiving a command from the server 2, the client device 7 proceeds to decision state 90, and determines whether or not the command received while at decision state 88 is a command to quit. If, while at decision state 90, the command received while at decision state 88 is determined to be a command to quit, the client device 7 continues to state 98, and stops execution of the application and resets. The client device 7 may also communicate status or other information to the server 2, and/or may receive such similar communications from the server 2. If, while at decision state 90, the command received from the server 2 while at decision state 88 is determined to not be a command to quit, the client device 7 proceeds back to state 86. If, while at decision state 88, a command from the server 2 is not received, the client device 7 advances to decision state 92, at which the client device 7 looks for a command from the user, such as a command to stop updating a region of the display array 30, or a command to quit. If, while at decision state 92, the client device 7 receives no command from the user, the client device 7 returns to decision state 88. If, while at decision state 92, a command from the user is received, the client device 7 proceeds to decision state 94, at which the client device 7 determines whether or not the command received in decision state 92 is a command to quit. If, while at decision state 94, the command from the user received while at decision state 92 is not a command to quit, the client device 7 proceeds from decision state 94 to state 96. At state 96 the client device 7 sends to the server 2 the user command received while at state 92, such as a command to stop updating a region of the display array 30, after which it returns to decision state 88. If, while at decision state 94, the command from the user received while at decision state 92 is determined to be a command to quit, the client device 7 continues to state 98, and stops execution of the application. The client device 7 may also communicate status or other information to the server 2, and/or may receive such similar communications from the server 2.

Figure 9:
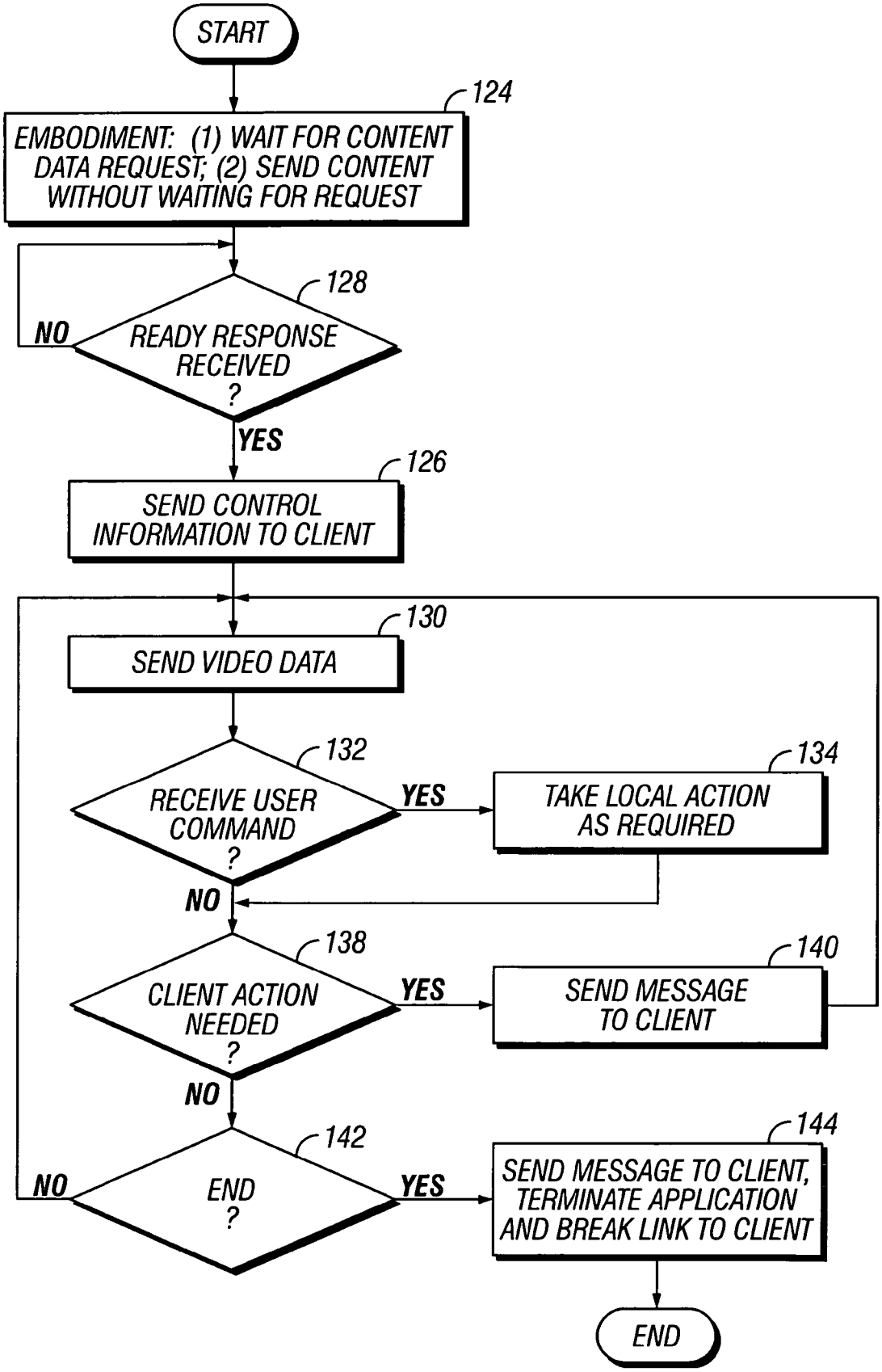
FIG. 9 is a flowchart of a server control process for sending video data to a client.

FIG. 9 illustrates a control process by which the server 2 sends video data to the client device 7. The server 2 sends control information and video data to the client device 7 for display. Depending on the embodiment, states of FIG. 9 can be removed, added, or rearranged.

Starting at state 124 the server 2, in embodiment (1), waits for a data request via the network 3 from the client device 7, and alternatively, in embodiment (2) the server 2 sends video data without waiting for a data request from the client device 7. The two embodiments encompass scenarios in which either the server 2 or the client device 7 may initiate requests for video data to be sent from the server 2 to the client device 7.

The server 2 continues to decision state 128, at which a determination is made as to whether or not a response from the client device 7 has been received indicating that the client device 7 is ready (ready indication signal). If, while at state 128, a ready indication signal is not received, the server 2 remains at decision state 128 until a ready indication signal is received.

Once a ready indication signal is received, the server 2 proceeds to state 126, at which the server 2 sends control data to the client device 7. The control data may stream from the server 2, or may be downloaded to the client device 7 memory for later access. The control data may segment the display array 30 into regions of arbitrary shape and size, and may define video data characteristics, such as refresh rate or interlaced format for a particular region or all regions. The control data may cause the regions to be opened or closed or re-opened.

Continuing to state 130, the server 2 sends video data. The video data may stream from the server 2, or may be downloaded to the client device 7 memory for later access. The video data can include motion images, or still images, textual or pictorial images. The video data can also have various compression encodings, and be interlaced or progressively scanned, and have various and varying refresh rates. Each region may receive video data with characteristics, such as refresh rate or compression encoding, specific only to that region.

The server 2 proceeds to decision state 132, at which the server 2 looks for a command from the user, such as a command to stop updating a region of the display array 30, to increase the refresh rate, or a command to quit. If, while at decision state 132, the server 2 receives a command from the user, the server 2 advances to state 134. At state 134 the server 2 executes the command received from the user at state 132, and then proceeds to decision state 138. If, while at decision state 132, the server 2 receives no command from the user, the server 2 advances to decision state 138.

At state 138 the server 2 determines whether or not action by the client device 7 is needed, such as an action to receive and store video data to be displayed later, to increase the data transfer rate, or to expect the next set of video data to be in interlaced format. If, while at decision state 138, the server 2 determines that an action by the client is needed, the server 2 advances to state 140, at which the server 2 sends a command to the client device 7 to take the action, after which the server 2 then proceeds to state 130. If, while at decision state 138, the server 2 determines that an action by the client is not needed, the server 2 advances to decision state 142.

Continuing at decision state 142, the server 2 determines whether or not to end data transfer. If, while at decision state 142, the server 2 determines to not end data transfer, server 2 returns to state 130. If, while at decision state 142, the server 2 determines to end data transfer, server 2 proceeds to state 144, at which the server 2 ends data transfer, and sends a quit message to the client. The server 2 may also communicate status or other information to the client device 7, and/or may receive such similar communications from the client device 7.

Because bi-stable displays, as do most flat panel displays, consume most of their power during frame update, it is desirable to be able to control how often a bi-stable display is updated in order to conserve power. For example, if there is very little change between adjacent frames of a video stream, the display array may be refreshed less frequently with little or no loss in image quality. As an example, image quality of typical PC desktop applications, displayed on an interferometric modulator display, would not suffer from a decreased refresh rate, since the interferometric modulator display is not susceptible to the flicker that would result from decreasing the refresh rate of most other displays. Thus, during operation of certain applications, the PC display system may reduce the refresh rate of bi-stable display elements, such as interferometric modulators, with minimal effect on the output of the display.

Figure 10:
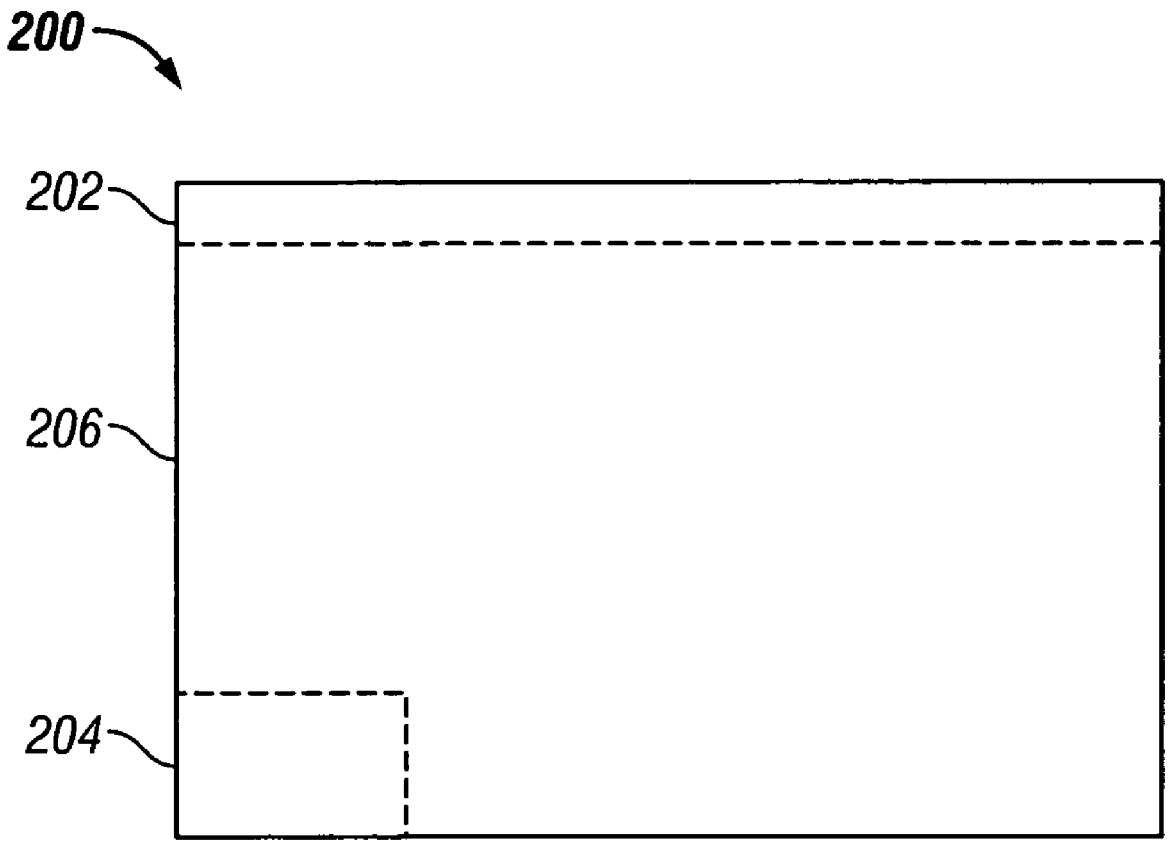
FIG. 10 is a plan view from the perspective of a viewer of one embodiment of an interferometric modulator display which can be partitioned into multiple viewing fields.

FIG. 10 illustrates, in plan view from the perspective of a viewer, one embodiment of an interferometric modulator display 200, which in this embodiment has been partitioned into a first field 202, a second field 204, and a third field 206. In these embodiments, the different fields of the interferometric modulator display 200, such as the first, second and third fields, 202, 204, 206, may be treated in a separate and different manner with respect to updating images displayed in the different fields 202, 204, 206 depending upon the nature of the images which are displayed in the respective fields 202, 204, 206.

For example, in one embodiment, the first field 202 can display a toolbar having multiple icons corresponding to different operational features which a device including the interferometric modulator display 200 can provide. It will be appreciated following a consideration of the description of the various embodiments, that the interferometric modulator display 200 can be incorporated into a variety of electronic devices including, but not limited to, cellular telephones, personal digital assistants (PDAs), text messaging devices, calculators, portable measurement or medical devices, video players, personal computers, and the like. Thus, in one embodiment the first field 202 can portray images corresponding to a toolbar having a plurality of icons which, during use, retain a constant configuration and location with respect to the interferometric modulator display 200, except perhaps a change of the coloration or highlighting of a particular icon in the first field 202 upon selection of the corresponding function. Thus, images displayed in the first field 202 of the interferometric modulator display 200, would typically require relatively infrequent updating or no updating in particular applications.

A second field 204 can correspond to a region of the interferometric modulator display 200 displaying images having significantly different upgrade demands than images portrayed in the first field 202. For example, the second field 204 may correspond to a series of video images which are portrayed on the interferometric modulator display 200 indicating a much higher update rate, such as at approximately 15 Hz corresponding to a video stream. Thus, the update requirements for images portrayed in the first field 202 could be of an infrequent aperiodic nature, such as substantially no updating during use if the image is constant or relatively infrequent aperiodic updating when, for example, a user selects an icon to activate a corresponding operational feature of a device incorporating the interferometric modulator display 200. However, the update requirements for images in the second field 204 would be of a generally periodic nature corresponding to the periodic framing of video data displayed in the second field 204. However, the updating of images displayed in the second field 204 can be readily conducted in an asynchronous manner with respect to updates provided for images in the first field 202. Furthermore, in some embodiments the fields may be overlapping, i.e., one field is designated as being on top of the other and covers the overlapped portion of the underlying field so that a interferometric modulator can be included in two or more fields. For example, where the display 200 is partitioned into a first field and a second field, a first plurality of interferometric modulators can correspond to the first field and a second plurality of interferometric modulators can correspond to the second field, one or more interferometric modulators of the first plurality of interferometric modulators can also be an interferometric modulator of the second plurality of interferometric modulators. In such embodiments, the interferometric modulator that is included in both fields is refreshed with the first plurality of interferometric modulators during a first refresh cycle and is refreshed with the second plurality of interferometric modulators during a second refresh cycle. One of more of the fields can be partitioned in any shape, for example, a square, circle, or a polygon.

Images displayed in the third field 206 can have yet other update requirements different from those of either the first field 202 or second field 204. For example, in one embodiment, the data displayed in the third field 206 can comprise text, such as e-mail or news content which a reader/user of the device may periodically scroll indicating a corresponding period of frequent updating of the images in the third field 206. However, this third field 206 would typically spend extended periods with the image relatively constant as the user reads the information displayed thus indicating periods of no updating. Thus the interferometric modulator display 200 can support update characteristics which are significantly time varying, such as periods of substantially no updating while the displayed image is static and relatively high rate updating when the image is changing. It will also be appreciated that the updating of the images displayed in the third field 206 can also be performed in an asynchronous manner with respect to the updating of data in the first and second fields 202, 204.

In certain embodiments, the interferometric modulator display 200 can also provide different update schemes in addition to different update rates, which can also reduce power consumption. For example, the first field 202 can be updated in a similar manner to progressive scan type drive schemes. The second field 204 could be driven with waveforms similar to those used for the first field 202, however instead of writing every row during each refresh cycle, every other row can be written in an interlaced manner. In another embodiment, the third field 206 can be updated on a per-pixel basis, for example, updating only pixels in the image that have changed while not refreshing or updating the others thus limiting the update to those pixels changing states. This embodiment can be advantageously employed when successive frames of data exhibit a relatively high degree of frame to frame correlation.

Figure 11:
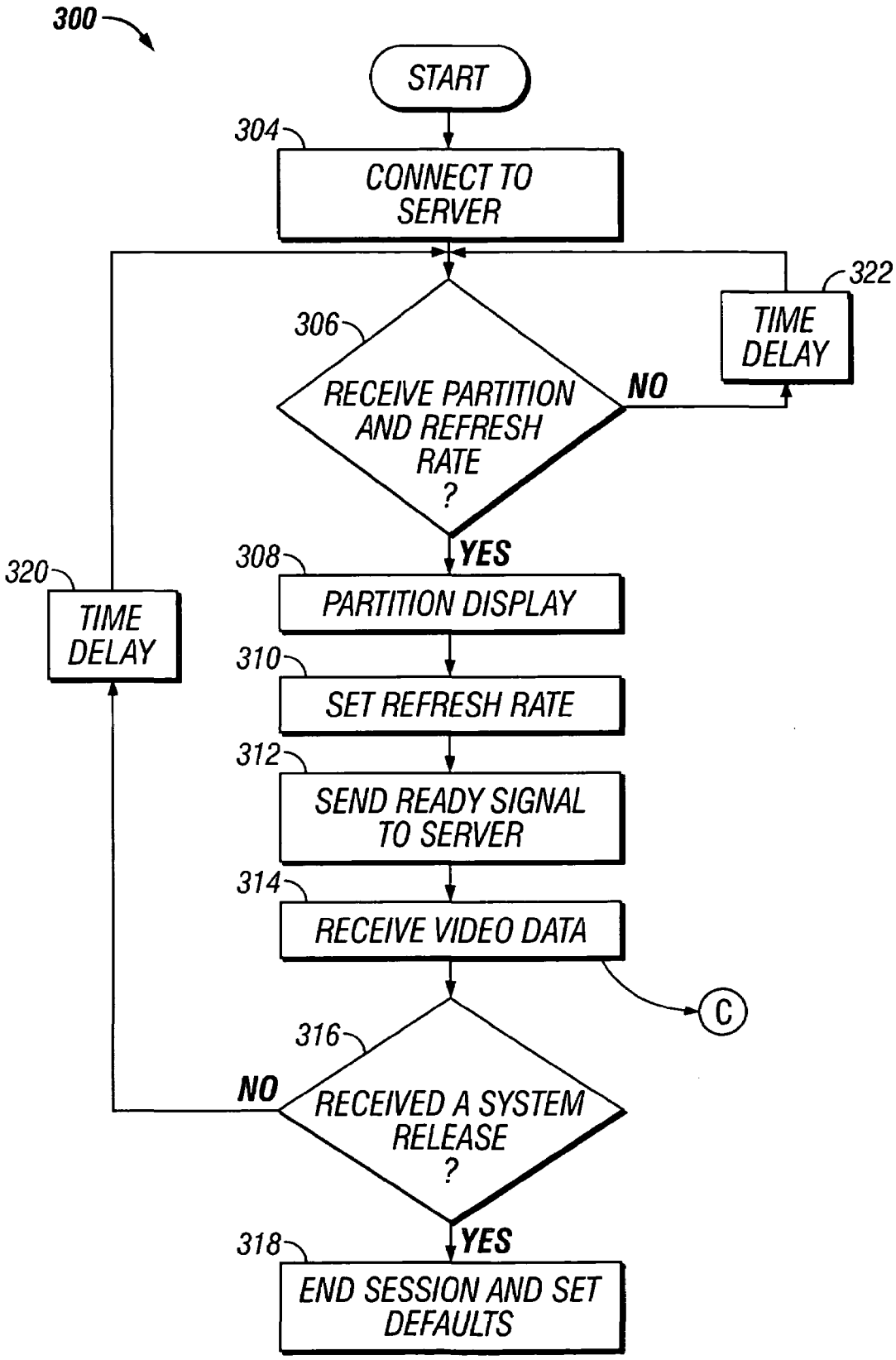
FIG. 11 is a flow chart illustrating a control process for partitioning a display and setting a refresh rate for each partition.

FIG. 11 is a high-level flow chart of one embodiment in which such a system can exploit the advantages of operational characteristics provided by the interferometric modulator display 200. Note the process illustrated in FIG. 11 comprises state 86 in the process described in FIG. 8. In the illustrated process, a client device 7 receives video data content from a server 2, defines fields within the interferometric modulator display 200 so that a portion of the data will be displayed on a corresponding field, sets or associates a refresh rate with each field based on the data or some other predetermined criteria, and displays the video data on the corresponding fields of the display 200. Depending on the embodiment, additional states may be added, others removed, and the ordering of the states rearranged.

The process 300 starts upon a triggering event for the client device 7 to receive data from the server 2. The triggering event can be initiated by a user, by a signal from the server directly or indirectly, or by the client device 7. In the process 300, at state 304 the client device 7 connects to the server 2. While connecting to the server 2, there can be an exchange of information between the client device 7 and the server 2, that can include identifying information about the client device 7, including display capabilities of the client device 7. After the client device 7 and the server 2 are connected, the process 300 continues to state 306 where the client device 7 checks to see if it received partition and refresh rate information. If it did not, the process 300 continues to state 322 where it has a time delay, and then loops back to state 306.

If the client device 7 received partition and refresh rate information, the process 300 proceeds to state 308 and partitions the display 200 based on the partition data. It will be appreciated that the partitioning of the data into one or more display fields can occur locally at the client device as well as from afar, such as provided by the server 2. Communications between the server 2 and the client device 7, including receiving server commands at the client device 7 and sending commands received at the client device (e.g., from a user) can be controlled as shown in FIG. 8. It will also be appreciated that the partitioning of state 308 can occur on a dynamic basis in a time varying manner such that, for example, during some periods, the display of data communicated via the network 3 between the server 2 and the client device 7 can occur without partitioning, e.g., in a single display field, and in yet other periods is partitioned into a plurality of different display fields depending upon the nature of the data being transmitted at any given time.

The process 300 continues to state 310 and sets the refresh rate for each partition. The process 300 continues to state 312 where it sends a signal to the server 2 indicating it is ready to receive video data. The server 2 sends video data to the client device 7 in response to receiving its readiness signal. The process 300 continues to state 314 and the client device 7 receives video data from the server 2. The handling of the received video data is shown in FIG. 12 with reference to the starting point at "C" in state 314.

The process 300 continues to state 316 and checks to see if the client device 7 received a signal indicating it was released from the server 2. If it did receive a release signal, the process 300 continues to state 318 where it ends its session connected to the server 2 and sets default parameters, as appropriate. If a release signal was not received, the process 300 continues to state 320, where it experiences a time delay at state 320 and then goes back to state 306.

Figure 12:
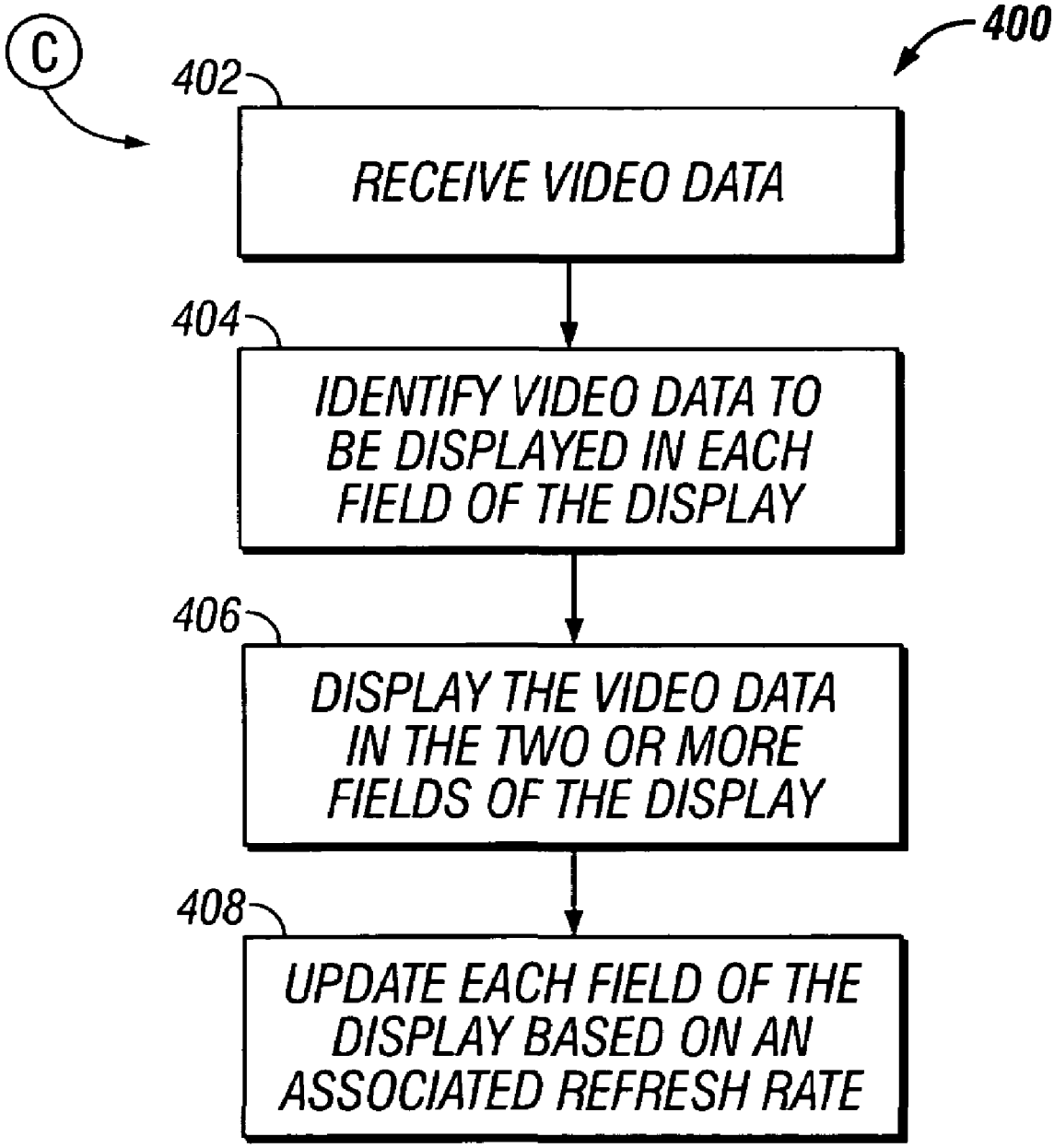
FIG. 12 is a high-level flow chart of embodiments of partitioning a display into one or more viewing fields and updating each of the one or more viewing fields at a corresponding appropriate update rate.

FIG. 12 is a high-level flow chart of an embodiment of a process 400 for partitioning a display into one or more viewing fields and updating each of the one or more viewing fields at a corresponding appropriate update rate. FIG. 12 illustrates certain states that occur in one embodiment with respect to state 314 of FIG. 11. Depending on the embodiment, additional states may be added, others removed, and the ordering of the states rearranged.

Process 400 starts at state 402 where the client device 7 receives video data. The process 400 continues to state 404 and identifies the video data to be displayed in the two or more partitioned fields of the display. Following the partitioning of state 404, the video content is displayed on the interferometric modulator display 200 of the client device 7 in state 406, where the partitioned video data is shown on a corresponding partitioned field of the display 200, and each of the one or more fields can be updated at an associated refresh rate. The refresh rate can be set using information received from the server 2, or it can be set and changed dynamically based on the content of the video data (e.g., based on whether the displayed image is changing fast or slow), or based on a user input. In one embodiment, the server 2 defines the location, size, geometry, and refresh rate for each of the fields. Furthermore, the server 2 may identify the video data transmitted to the client device 7 that is to be displayed in a particular field.

These embodiments efficiently utilize available resources while maintaining a high quality of the images displayed on the interferometric modulator display 200. For example, in one embodiment, a server 2 may provide a text file to the client device 7 via the network 3. Upon receipt of the text file, the client device 7 can partition the text data in one or more fields 202, 204, 206 of the display 200. However, once the data is displayed on the interferometric modulator device 200 no further updates are required until the video data displayed in the one or more partitions 202, 204, 206 changes. If the text file data comprises a relatively brief e-mail message, the entire e-mail message can be portrayed in the one or more fields of the interferometric modulator display 200 and until the displayed image changes, such as by the user scrolling through a more extensive e-mail message, switching operational modes of the client device 7, or other conditions indicating a change in the displayed information, neither the server 2 nor the client device 7 needs to refresh the image. This offers the significant advantage that available battery and processing capacity at the client device 7 is not significantly consumed simply by maintaining a static image displayed in the interferometric modulator display 200.

Similarly, the available processing and transmission bandwidth capacity of the server 2 can be more efficiently utilized by exploiting the characteristics provided by the interferometric modulator displays 200. For example, in certain embodiments, the server 2 has established that it is in communication via the network 3 with a client device 7 having an interferometric modulator display 200. The partitioning of the displayed data of state 404 can thus take place at the server 2, also known as the "head-end" in certain applications. Thus the server 2 can provide data to the client device 7 in a partitioned manner which can be dynamically adjusted to the needs of each of a multiplicity of client devices 7. For example, data provided by the server 2 can be provided to one client device 7 at a first update rate which can be relatively low and even substantially zero for certain periods of time, saving the bandwidth and processing capacity of the server 2 to provide data via other links to other client devices at second, higher update rates corresponding to different requirements of the data being provided to the other client devices.

Various embodiments provide unique operational characteristics of interferometric modulator displays 200 to provide the capability of partitioning a display into one or more fields 202, 204, 206, each having its own defined refresh rate. One or more of the update rates can be at a substantially zero rate, e.g., no updating at least for limited periods of time. A further embodiment comprises a dynamic data display system including a server 2 in communication with one or more client devices 7 wherein the characteristics of the client devices 7 are communicated to the server 2 and wherein data provided to each of the client devices 7 is formatted differently according to the characteristics of each of the client devices. For example, the refresh rate may depend on the type of data being displayed. In some embodiments, frames of a video stream are skipped, based on a programmable "frame skip count." For example in some embodiments, the array driver 22 may be programmed to skip a number of refreshes that are available with the display array 30. In one embodiment, a register in the array driver 22 stores a value, such as 0, 1, 2, 3, 4, etc, that represents a frame skip count. The array driver 22 may then access this register in order to determine the frequency of refreshing the display array 30. For example, the values 0, 1, 2, 3, 4, and 5 may indicate that the driver updates every frame, every other frame, every third frame, every fourth frame, every fifth frame, and every sixth frame, respectively.

Figure 13:
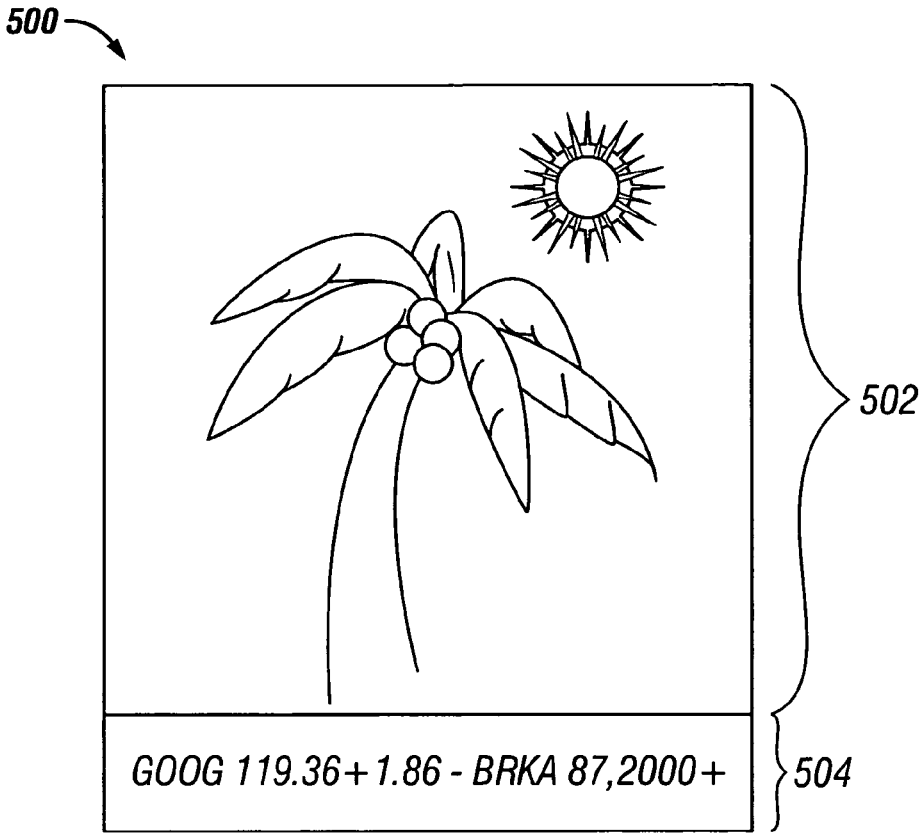
FIG. 13 is an exemplary illustration of a partitioned display of a client.

One embodiment of a display 500 is illustrated in FIG. 13. The display 500 of FIG. 13 may be manufactured in a variety of shapes and sizes. In one embodiment, the display 500 is generally rectangular, although in other embodiments the display is square, hexagonal, octagonal, circular, triangular, or other symmetric or non-symmetric shape. The display 500 may be manufactured in a variety of sizes. In one embodiment, one side of the display 500 is less than about 0.5 inches, about one inch, about 10 inches, about 100 inches, or more than 100 inches long. In one embodiment, the length of one side of the display 500 is between about 0.5 inches and 3.5 inches long.

The display 500 may be partitioned into partitions 502 and 504 depending upon the content to be displayed therein. By partitioning the display, different display partitions are able to display different content and are able to be refreshed or updated at different rates. For example, only those partitions of the display 500 that require updating or refreshing may be updated or refreshed. With reference to FIG. 13, the first partition 502 displays an image that does not require updating or refreshing as frequently as the second partition 504. For example, the first partition 502 displays a still image (as shown), while the second partition 504 displays a stock-market ticker-tape (as shown), motion video, or a clock.

In one embodiment, a display 500 includes two partitions, although in other embodiments, the display 500 includes more than two partitions. For example, the display 500 may include three, four, eight, 32, or 256 partitions. In one embodiment, the display 500 includes a relatively low refresh-rate partition and a relatively high refresh-rate partition. The relative size and position of the partitions of the display 500 may be fixed or may change depending upon the content to be shown on the display 500. In one embodiment the ratio of surface area of first partition 502 to second partition 504 is about 90:10, about 75:25, about 50:50, about 25:75, or about 10:90.

In one embodiment, control commands or messages are received by the client device 7 from the server 2 (not shown), and these control commands or messages determine the manner in which the display 500 partitions itself, and the rate in which the content of the partitions is updated or refreshed.

Figure 14:
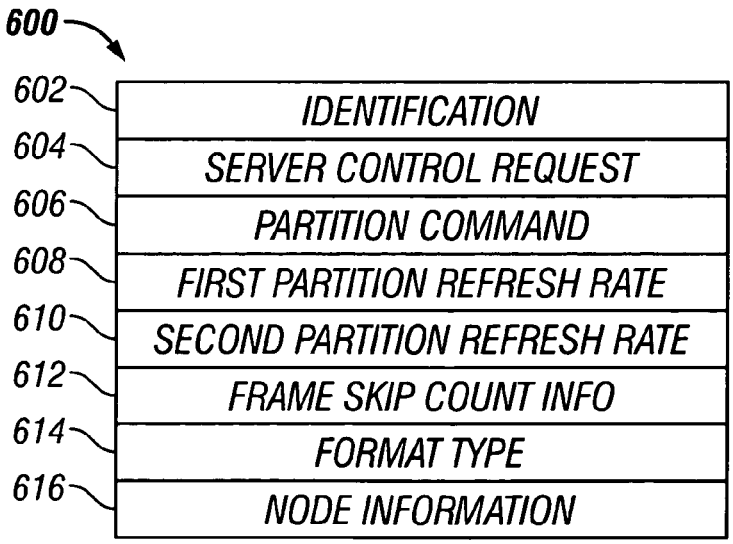
FIG. 14 is one example of a server-provided message.

One example of a server-provided message or command for establishing the partitioning of a display 500 is illustrated in FIG. 14. A server-provided message 600 can include one or more of an identification segment 602, a server control request 604, a partition command 606, a first partition refresh rate value 608, a second partition refresh rate value 610, frame skip count information 612, format type 614, and node information 616.

In one embodiment, the identification segment 602 identifies the type of content being sent to the client device 7 (not shown). For example, if the content is a phone call, the caller's phone number may be provided. If the content is from a web-site, an indicia of the identity of the web-site may be provided via the identification segment 602. The server control request 604 is a request from the server for the client to grant the server control over its display and refresh and/or update rates. The partition command 606 includes the instructions to the client as to how its display (not shown) is to be partitioned. The partition command 606 may include one or more rows or columns of the display at which the display is to be partitioned. The first partition refresh rate value 608 indicates the rate at which content to be displayed in the display's first partition is to be updated or refreshed, and the second partition refresh rate value 610 indicates the rate at which the content to be displayed in the display's second partition is to be updated or refreshed. In some embodiments, the server message 600 also includes frame skip count information 612, video data format type 614, and/or other information such as node information 616. The frame skip count information 612 can be used to determine whether to display a frame of video data, as discussed hereinabove. The video data format type 614 can be used by the server 2 to indicate to the client device 7 what type of data is being sent from the server 2. The node information 616 in the message can be used to indicate to the client device 7 node or network device information relating to the data being sent from the server 2.

It should be noted, and is discussed in embodiments below, that the partition update and refresh rates specified in server messages or determined based on local criteria within the client device 7 are not limited to specific, set numerical values. Updates and refresh "rates" can be based on dataset fulfillment criteria, triggering events, interrupts, user interaction, and other stimuli. This situation can lead to varying, situational-dependent, and asynchronous refresh and update events.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

The invention claimed is:

1. A display system, comprising:

at least one driving circuit configured to provide signals for displaying video data; and a display comprising an array having a plurality of bi-stable display elements, the array being configured to display video data using signals received from the driving circuit, wherein the array is partitioned into one or more fields, each field including at least one bi-stable display element and wherein the driving circuit is configured to refresh each of the one or more fields in accordance with a refresh rate associated with each field, wherein the plurality of bi-stable display elements comprise interferometric modulators, and wherein the one or more fields comprise a first field comprising a first set of interferometric modulators and a second field comprising a second set of interferometric modulators, and wherein at least one interferometric modulator of the first set of interferometric modulators is also an interferometric modulator of the second set of interferometric modulators.

2. The system of claim 1, wherein the driving circuit is configured to partition the array.

3. The display system of claim 1, further comprising an input device configured to receive a user selection, wherein the driving circuit is configured to partition the array based on the user selection.

4. The display system of claim 1, further comprising:

a server in communication with the display system, wherein the driving circuit is configured to partition the array based on instructions from the server.

5. The display system of claim 1, wherein the driving circuit is configured to receive at least a portion of the video data from a server in communication with the display system.

6. The display system of claim 1, wherein the driving circuit is configured to receive at least a portion of the video data from a process running on the display system.

7. The display system of claim 1, wherein the first set of interferometric modulators is refreshed at a first refresh rate and the second set of interferometric modulators is refreshed at a second refresh rate.

8. The display system of claim 7, wherein the second refresh rate is different than the first refresh rate.

9. The display system of claim 7, wherein the second refresh rate is the same as the first refresh rate, and refresh of the first field starts at a different time than the refresh of the second field.

10. The display system of claim 7, wherein the first refresh rate is determined based at least in part on a frame rate of the data that is displayed in the first field.

11. The display system of claim 7, wherein the first refresh rate is predetermined.

12. The display system of claim 7, wherein the first refresh rate changes over time.

13. The display system of claim 1, wherein the first set of interferometric modulators is arranged in the shape of a polygon.

14. The display system of claim 9, wherein the at least one interferometric modulator is refreshed with the first set of interferometric modulators during a first refresh cycle and the at least one interferometric modulator is refreshed with the second set of interferometric modulators during a second refresh cycle.

15. A method of displaying data on a display of a device, the method comprising:

partitioning a bi-stable display of the device into one or more fields, wherein the one or more fields comprise a first field comprising a first set of interferometric modulators and a second field comprising a second set of interferometric modulators, and wherein at least one interferometric modulator of the first set of interferometric modulators is also an interferometric modulator of the seconed set of interferometric modulators;

displaying video data in the one or more fields; and refreshing each of the one or more fields in accordance with a refresh rate that is associated with each of the one or more fields.

16. The method of claim 15, further comprising receiving at least a portion of the video data at the device from a server.

17. The method of claim 16, wherein at least one of the one or more update schemes is selected using a program associated with the received data.

18. The method of claim 15, further comprising updating the one or more fields using one or more update schemes.

19. The method of claim 15, wherein refreshing at least one of the one or more fields comprises using a refresh rate that is based on a frame rate of the data that is displayed.

20. The method of claim 15 further comprising receiving display information that indicates a characteristic of the display, and selecting an update scheme using the display information.

* * * * *

UNITED STATES PATENT AND TRADEMARK OFFICE

CERTIFICATE OF CORRECTION

PATENT NO. : 7,586,484 B2
APPLICATION NO. : 11/096546
DATED : September 8, 2009
INVENTOR(S) : Jeffrey B. Sampsell, Karen Tyger and Mithran Mathew It is certified that error appears in the above-identified patent and that said Letters Patent is hereby corrected as shown below:

On the Title Pg Item (56)

Pg 5, Line 20, please delete "Silicon" and insert therefore, --Silicone--.

Pg 5, Line 21, please delete "THAHW" and insert therefore, --THAW--.

Pg 5, Line 24, please delete "Michromachining" and insert therefore, --Micromachining--.

At Column 23, Line 11, in Claim 14, after "claim" please delete "9," and insert therefore, --1,--.

At Column 24, Line 3, in Claim 15, please delete "seconed" and insert therefore, --second--.

Signed and Sealed this

Twenty-seventh Day of April, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,586,484 B2
APPLICATION NO. : 11/096546
DATED : September 8, 2009
INVENTOR(S) : Sampsell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 927 days.

Signed and Sealed this

Fourteenth Day of September, 2010

David J. Kappos

David J. Kappos
*Director of the United States Patent and Trademark Office*